US008753103B1

(12) United States Patent
Collison et al.

(10) Patent No.: US 8,753,103 B1
(45) **Date of Patent: *Jun. 17, 2014**

(54) DRY-CAST CONCRETE BLOCK MOLDING MACHINE

(71) Applicants: Ryan W. Collison, Pierce, NE (US); Beau R. Collison, Pierce, NE (US)

(72) Inventors: Ryan W. Collison, Pierce, NE (US); Beau R. Collison, Pierce, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/766,344

(22) Filed: Feb. 13, 2013

Related U.S. Application Data

(63) Continuation-in-part of application No. 12/930,094, filed on Dec. 28, 2010, now Pat. No. 8,398,391.

(51) Int. Cl.

| | |
|---|---|
| ***B28B 13/02*** | (2006.01) |
| ***B28B 13/04*** | (2006.01) |
| ***B28B 3/02*** | (2006.01) |
| *B28B 5/04* | (2006.01) |
| *B28B 7/00* | (2006.01) |

(52) U.S. Cl.

CPC ..... *B28B 13/0205* (2013.01); *B28B 3/022* (2013.01); *B28B 5/04* (2013.01); *B28B 7/0088* (2013.01); *B28B 7/0097* (2013.01); *B28B 3/021* (2013.01); *B28B 13/0215* (2013.01); *B28B 13/023* (2013.01); *B28B 13/025* (2013.01)

USPC ..... 425/253; 425/260; 425/261; 425/447; 425/412; 425/441; 425/148; 425/140; 425/330; 425/256; 425/259; 425/469; 425/413; 425/421; 425/406; 425/145

(58) Field of Classification Search

CPC ..... B28B 3/021; B28B 3/022; B28B 5/04; B28B 7/0088; B28B 7/0097; B28B 13/0205; B28B 13/0215; B28B 13/023; B28B 13/025; B28B 2005/045; B28B 2005/04; B28B 2013/024; B28B 2013/023

USPC ..... 425/469, 413, 421, 253, 145, 148, 140, 425/330, 256, 259, 260, 261, 447, 406, 412, 425/441; 264/333

See application file for complete search history.

(56) References Cited

U.S. PATENT DOCUMENTS

| | | | | |
|---|---|---|---|---|
| 4,164,537 | A * | 8/1979 | Drostholm et al. | 264/333 |
| 4,337,694 | A * | 7/1982 | Brown | 100/45 |
| 4,668,151 | A * | 5/1987 | Oberoi et al. | 414/331.07 |
| 5,490,363 | A | 2/1996 | Woolford | |
| 5,503,546 | A * | 4/1996 | Aaseth et al. | 425/258 |
| 5,589,124 | A | 12/1996 | Woolford et al. | |
| 5,711,129 | A | 1/1998 | Woolford | |
| 5,827,015 | A | 10/1998 | Woolford et al. | |
| 6,142,713 | A | 11/2000 | Woolford et al. | |
| 6,183,168 | B1 | 2/2001 | Woolford et al. | |

(Continued)

*Primary Examiner* — Joseph S Del Sole
*Assistant Examiner* — Lawrence D Hohenbrink, Jr.
(74) *Attorney, Agent, or Firm* — Dennis L. Thomte; Thomte Patent Law Office LLC

(57) ABSTRACT

A dry-cast concrete block molding machine including an apparatus which successively positions block mold trays into the mold box of the molding machine with the apparatus pushing a molded block from the mold box as an empty mold tray is moved into the mold box. The machine also includes a magazine-like structure which has empty tray molds stacked therein.

3 Claims, 23 Drawing Sheets

(56) References Cited

U.S. PATENT DOCUMENTS

| | | | | |
|---|---|---|---|---|
| 6,312,197 | B1 | 11/2001 | Woolford et al. | |
| 6,312,629 | B1 * | 11/2001 | Gusack et al. | 264/37.29 |
| 6,616,382 | B2 | 9/2003 | Woolford et al. | |
| 6,616,874 | B1 * | 9/2003 | Lazar | 264/71 |
| 7,156,645 | B2 * | 1/2007 | Ness | 425/441 |
| 7,695,268 | B2 * | 4/2010 | Klettenberg | 425/353 |
| 8,398,391 | B2 | 3/2013 | Collison | |
| 2009/0255211 | A1 | 10/2009 | Collison | |

* cited by examiner

DRY-CAST CONCRETE BLOCK MOLDING MACHINE

CROSS REFERENCE TO RELATED APPLICATION

This is a Continuation-In-Part of application Ser. No. 12/930,094 (now U.S. Pat. No. 8,398,391) filed Dec. 28, 2010 entitled A DRY-CAST CONCRETE BLOCK MOLDING MACHINE.

BACKGROUND OF THE INVENTION

1. Field of the Invention

This invention relates to a dry-cast concrete block molding machine and more particularly to an apparatus which successively positions block mold trays into the mold box of the molding machine with the apparatus pushing a molded block from the mold box as an empty mold tray is moved into the mold box.

2. Description of the Related Art

Many types of dry-cast concrete molding or making machines have been previously provided. See for example U.S. Pat. Nos. 6,616,874 and 7,341,685. In some of the prior art machines, dry-cast concrete is conveyed into a dump box or hopper located at the upper end of the machine. A person is positioned near the dump hopper and attempts to visually determine when the proper amount of concrete for an individual block has been placed into the dump hopper. When the person believes that the correct amount of concrete has been placed into the dump hopper, the person stops the conveyor. If too much concrete has been placed in the dump hopper, the excess concrete presents a problem. If too little concrete has been placed in the dump hopper, an imperfect block will be molded requiring the imperfect block to be discarded.

A second problem associated with the prior art dry-cast concrete block molding machines is that the mold box thereof can only mold a concrete block having one configuration. If it is necessary to produce a different type of concrete block, the entire mold box of the machine must be replaced.

A third problem associated with prior art dry-cast concrete blocking molding machines is the lack of a method of conveniently conveying mold trays to the mold box and the lack of a method of conveniently removing the molded concrete blocks and the trays from the mold box.

Applicants' dry-cast concrete block molding machine of the co-pending application solved most, if not all, of the problems of the prior art machines. However, Applicants have invented an improved means for successively positioning mold trays in the mold box of the molding machine which is the subject of this application.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A dry-cast concrete block molding machine is provided which includes an upstanding frame means having an upper end, a lower end, a first side, a second side, a front side and a back side. A concrete weigh hopper is positioned at the upper end of the frame means with the concrete weigh hopper having an open upper end. The concrete weigh hopper is pivotally movable from a concrete receiving position to a dumping position. A concrete conveyor for conveying dry-cast concrete is provided to supply dry-cast concrete to the upper end of the concrete weigh hopper. A concrete chute is mounted on the frame means below the concrete weigh hopper and has an open upper end and an open lower end. A shot glass assembly is positioned below the concrete chute and which is selectively horizontally movably mounted on the frame means between a first position and a second position. The shot glass assembly has an open upper end and an open lower end. The shot glass assembly, when in its first position has its open upper end positioned directly below the open lower end of the concrete chute so that dry-cast concrete dumped from the concrete weigh hopper into the open upper end of the concrete chute will pass downwardly into the open upper end of the shot glass assembly. The shot glass assembly, when in its second position, has its open upper end positioned laterally of the open lower end of the concrete chute.

A concrete mold box is mounted on the frame means and is positioned directly below the open upper end of the shot glass assembly when the shot glass assembly is in its second position. The concrete mold box includes a bottom wall, an upstanding front side, an upstanding back side, an open first side and an open second side. An upstanding first mold box end plate is selectively movably mounted on the frame means and is selectively horizontally movable on the frame means between open and closed positions relative to the mold box. The first mold box end plate, when in its closed position, closes the open first side of the mold box. An upstanding second mold box end plate is also provided which is selectively horizontally movably mounted on the frame means between open and closed positions relative to the mold box. The second mold box end plate, when in its closed position, closes the open second side of the mold box.

A first vertically disposed power cylinder is mounted on the frame means and includes a cylinder body and a cylinder rod selectively movably extending downwardly therefrom. The cylinder body of the first power cylinder is positioned above the mold box and above the shot glass assembly. The cylinder rod of the first power cylinder is selectively movable between retracted and extended positions. A compaction head is mounted on the cylinder rod of the first power cylinder so that extension of the cylinder rod of the first power cylinder causes the compaction head to move downwardly through the shot glass assembly when the shot glass assembly is in its second position, to force the dry-cast concrete therein downwardly into the mold box, when the first and second mold box end plates are in their closed positions, to compact the dry-cast concrete in the mold box. A vibrator is also utilized to vibrate the concrete in the mold box.

The first and second mold box end plates are movable from their closed positions to their open positions after the dry-cast concrete has been compacted in the mold box and the cylinder rod of the first power cylinder has been moved to its retracted position.

An apparatus is positioned at the first side of the frame means adjacent the inlet side of the mold box for successively positioning empty mold trays into the mold box and for pushing a molded concrete block from the mold box as an empty mold tray is pushed into the mold box.

It is therefore principal object of the invention to provide an improved dry-cast concrete block molding machine.

A further object of the invention is to provide a dry-cast concrete block molding machine including an apparatus for pushing mold trays into the mold box and which also pushes the molded concrete block and its mold tray from the mold box.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
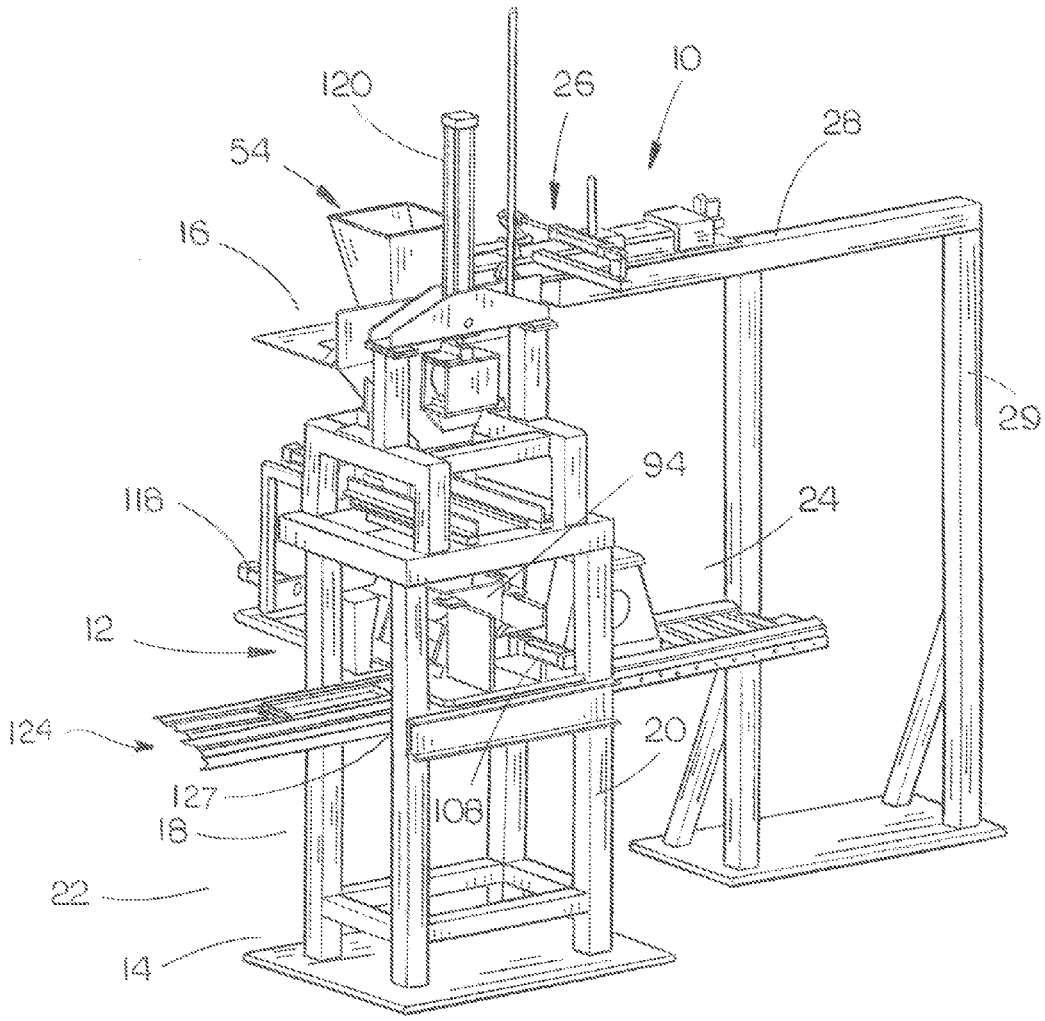
FIG. 1 is a front perspective view of the dry-cast concrete block molding machine of the co-pending invention.
Figure 2:
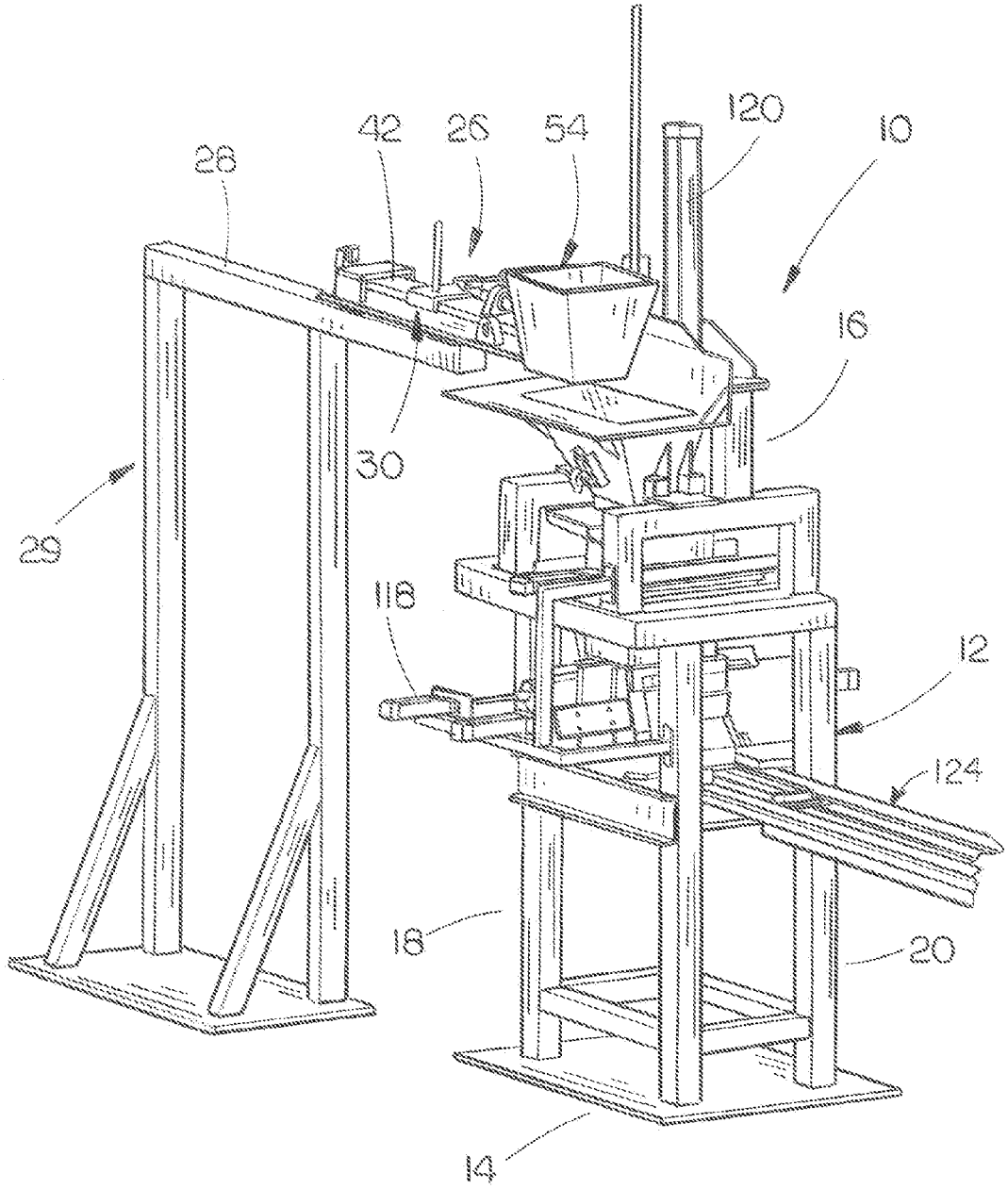
FIG. 2 is a rear perspective view of the dry-cast concrete block molding machine of the co-pending application.
Figure 3:
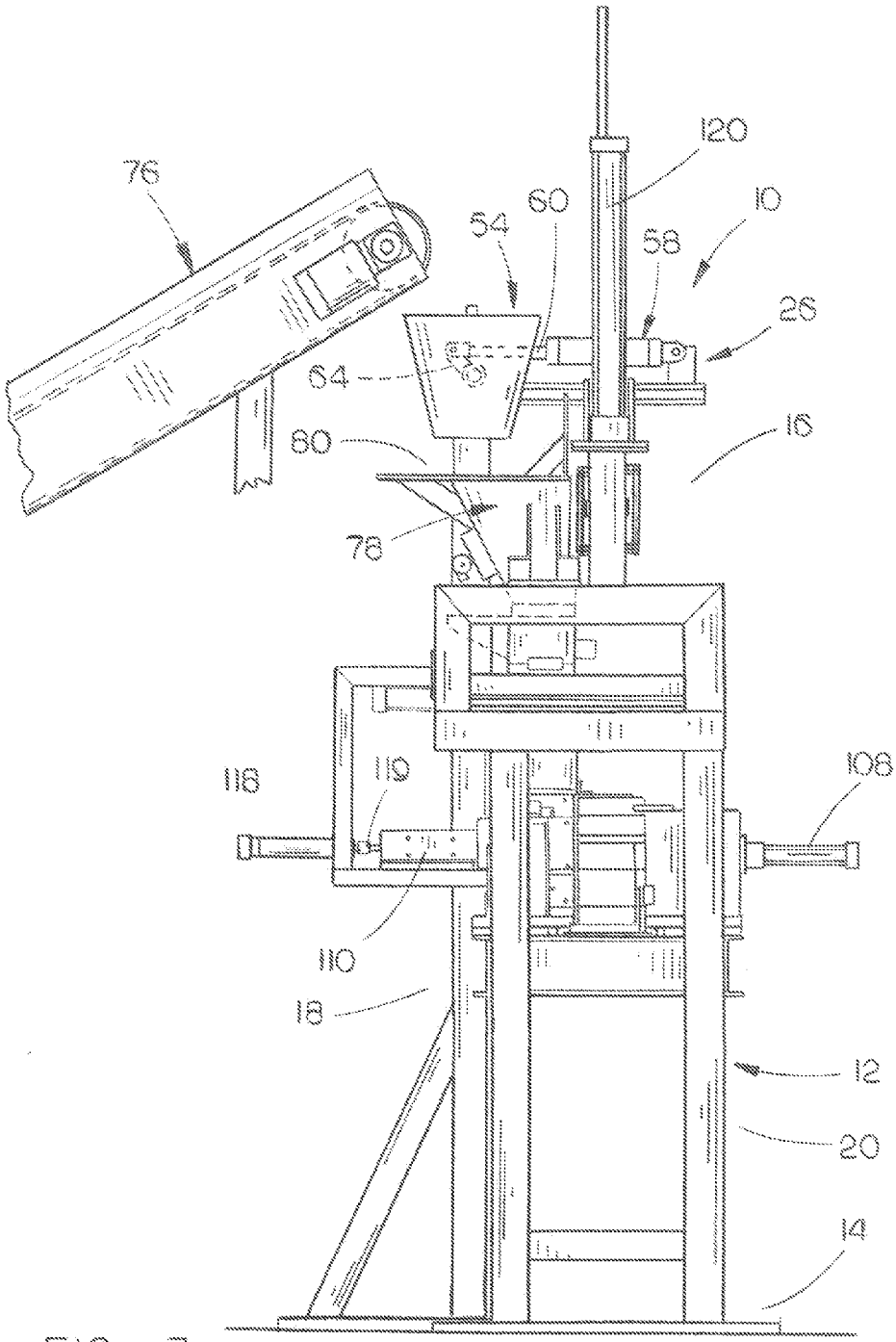
FIG. 3 is a side elevational view of the dry-cast concrete block molding machine of the co-pending application which illustrates its relationship with respect to a dry-cast concrete conveyor.
Figure 4:
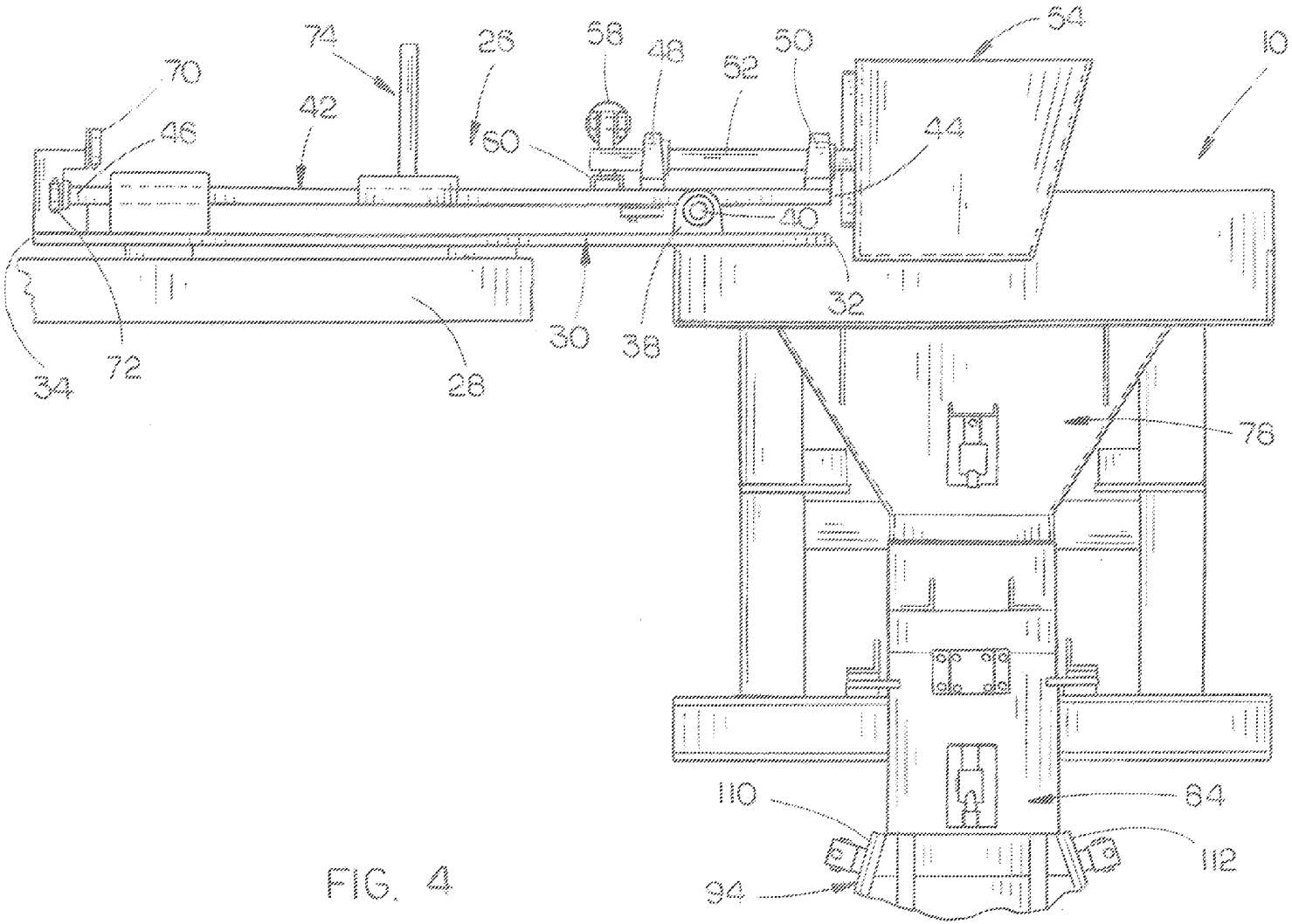
FIG. 4 is a side elevational view of the concrete weigh hopper of the co-pending application positioned at the upper end of the frame means and its relationship to a scale.
Figure 5:
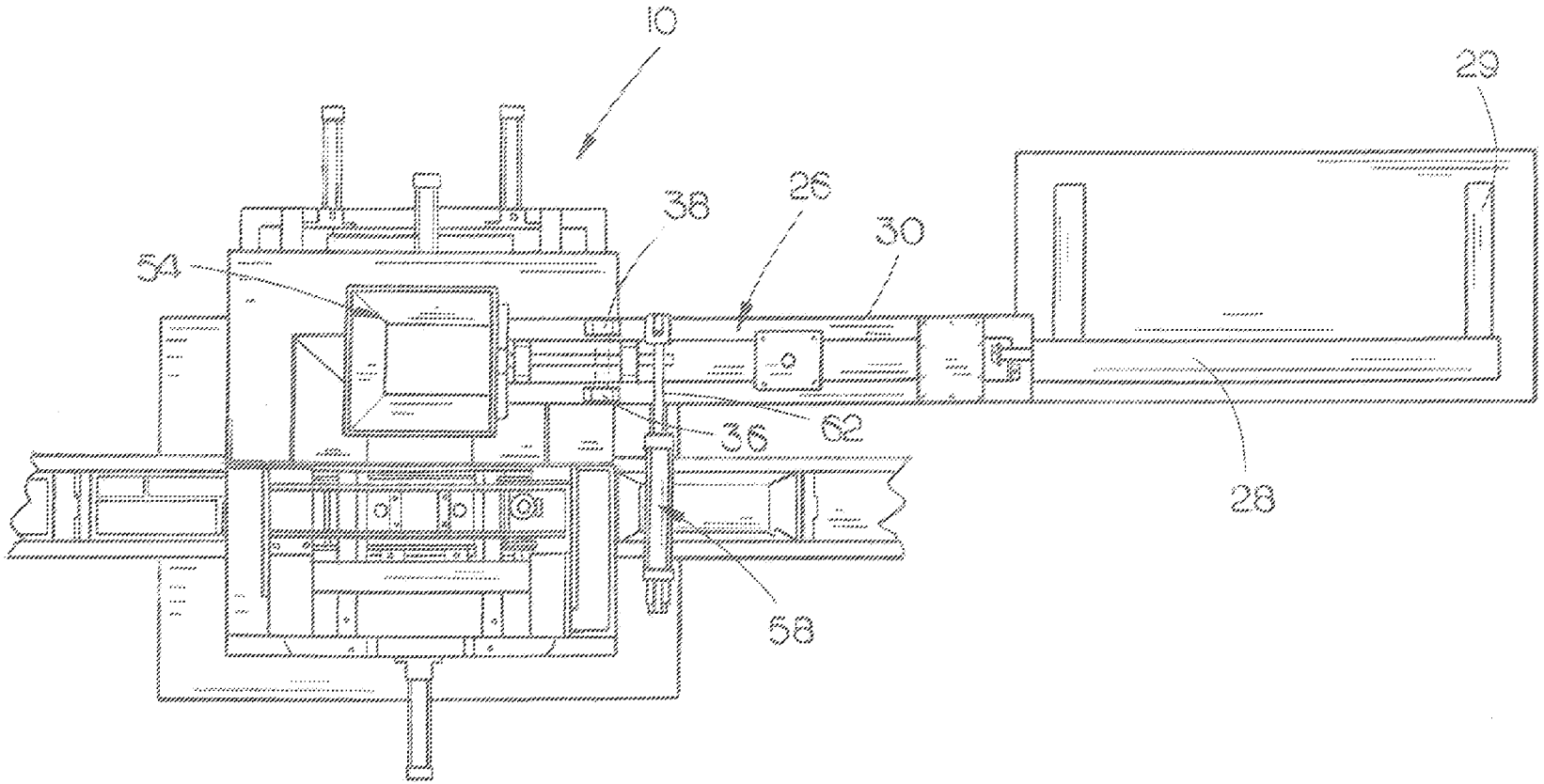
FIG. 5 is a partial top view of the dry-cast concrete block molding machine of the co-pending application.
Figure 6:
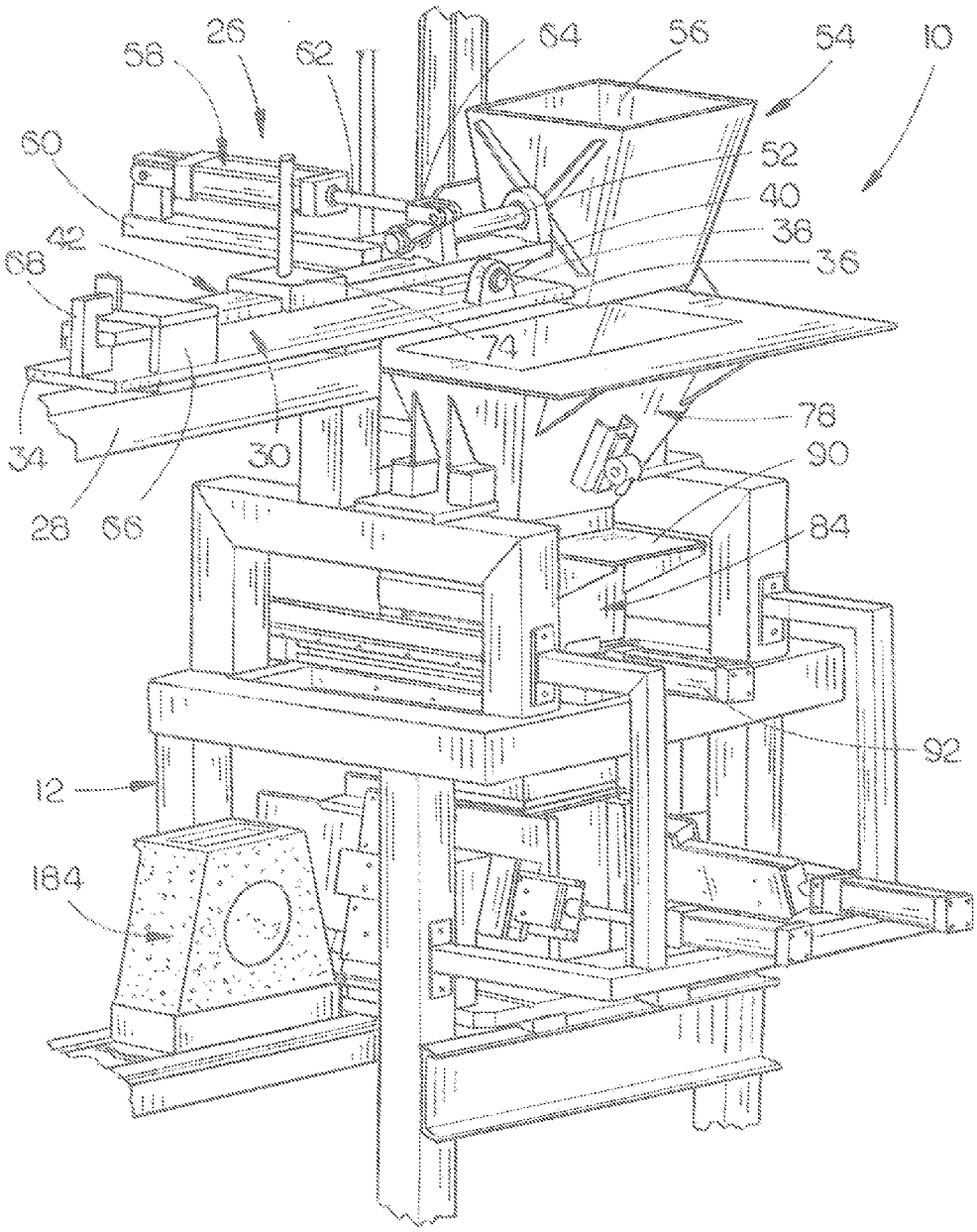
FIG. 6 is a partial rear perspective view of the dry-cast concrete block molding machine of the co-pending application illustrating a concrete block being discharged from the machine.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

FIGS. 1-13 illustrate the dry-cast concrete block molding machine of the co-pending application Ser. No. 12/930,094, filed Dec. 28, 2010, which is incorporated herein to complete this disclosure if required.

The dry-cast concrete block molding machine of the co-pending application is referred to generally by the reference numeral 10. Machine 10 includes an upstanding frame means 12 having a lower end 14, an upper end 16, a back side 18, a front side 20, a left or first side 22 and right or second side 24.

Weigh scale hopper assembly 26 is mounted on a horizontally extending frame member 28 which is supported by an upstanding frame means 29. Assembly 26 includes an elongated flat support member 30 having an inner end 32 and an outer end 34. Support member 30 is secured to frame member 28 by bolts or the like. A pair of spaced-apart bearings 36 and 38 is secured to the upper surface of support member 30 outwardly of the inner end 32 thereof. A shaft 40 is rotatably mounted in bearings 36 and 38 and extends therebetween.

An elongated flat support member or balance beam 42 is positioned above support member 30 and has an inner end 44 and an outer end 46. Shaft 40 is secured to the underside of support member 42 by any convenient means so that support member 42 may pivot with respect to support member 30 about a horizontally disposed axis transverse with respect to the longitudinal axis thereof. Horizontally spaced-apart bearings 48 and 50 are secured to support member 42 by bolts or the like. Shaft 52 is rotatably mounted in bearings 48 and 50 and extends therebetween. The inner end of shaft 52 is secured to the side of a hopper 54 having an open upper end 56 so that rotation of shaft 52 causes hopper 54 to be pivotally moved from a non-dumping position to a dumping position and vice versa. An air cylinder 58 is mounted on frame member 60 of frame means 12. The cylinder rod 62 of air cylinder 58 is pivotally secured to a yoke or connector 64 which is pivotally secured to shaft 52 so that retraction of the rod 62 will cause the hopper 54 to be pivotally moved from its non-dumping position to its dumping position. Conversely, extension of the rod 62, when hopper 54 is in its dumping position, will cause hopper 54 to be pivotally moved to its non-dumping position.

The numeral 66 refers to a support which is secured to support member 30 adjacent the outer end thereof with support member 42 extending through support 66. An upstanding plate 68 is secured at its lower end to support member 30 and extends upwardly therefrom. A normally open upper electrical switch 70 is secured to plate 68 so as to be in the upward pivotal path of the outer end of support member 42. A lower electrical switch 72 is secured to plate 68 so as to be in the pivotal path of the outer end of support member 42. The numeral 74 refers to a balance weight which is longitudinally adjustably mounted on support member 42.

The numeral 76 refers to a conventional conveyor which conveys the dry-cast concrete material to the open upper end 56 of hopper 54.

The numeral 78 refers to a hollow chute which is fixedly mounted on the frame means 12 below the hopper 54. Chute 78 has an open upper end 80 and an open lower end 82. As seen, the back wall of chute 78 tapers forwardly and downwardly.

Figure 7:
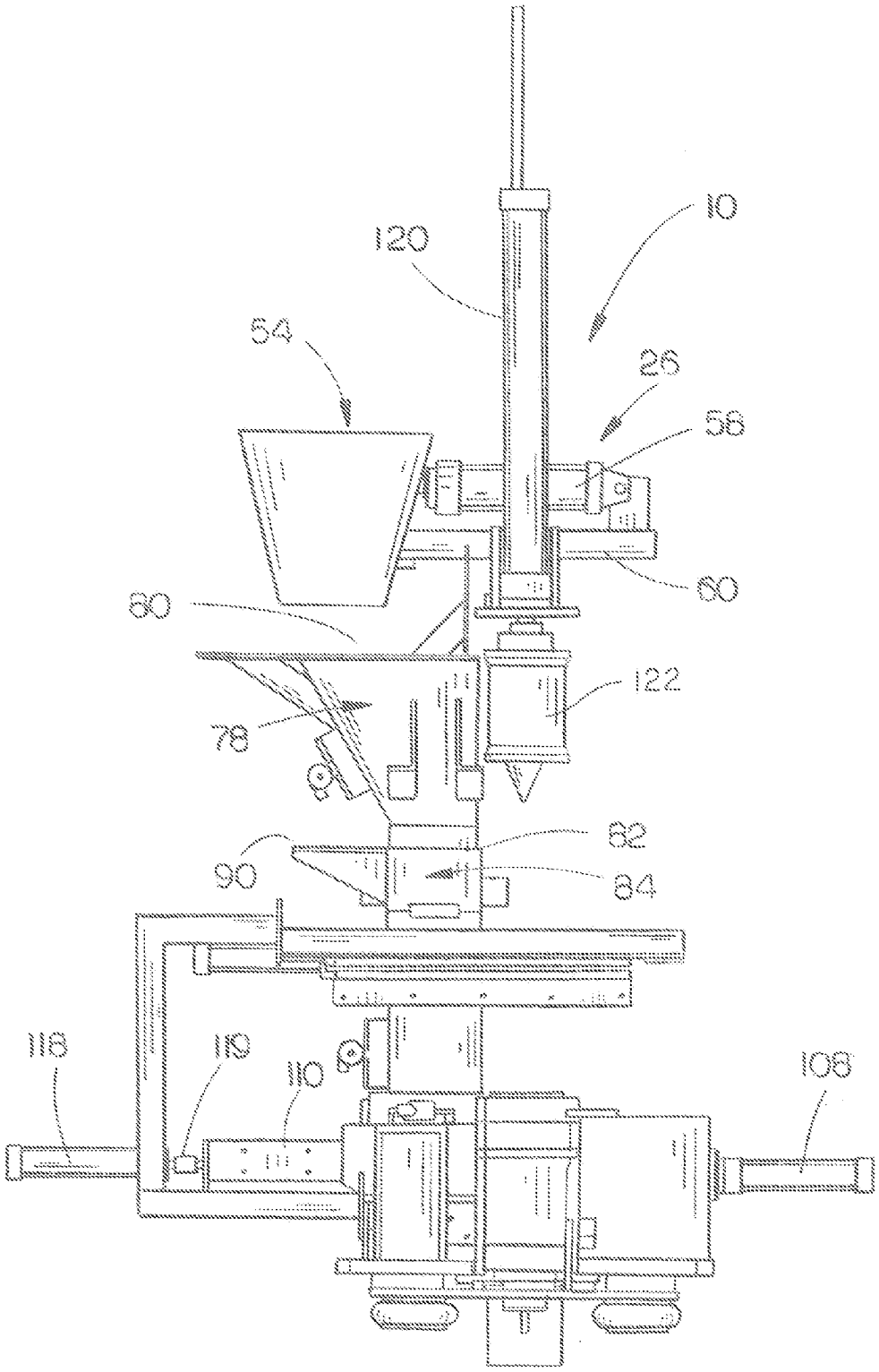
FIG. 7 is a partial side view of the dry-cast concrete block molding machine of the co-pending application with the shot glass assembly thereof being illustrated in a first position.
Figure 8:
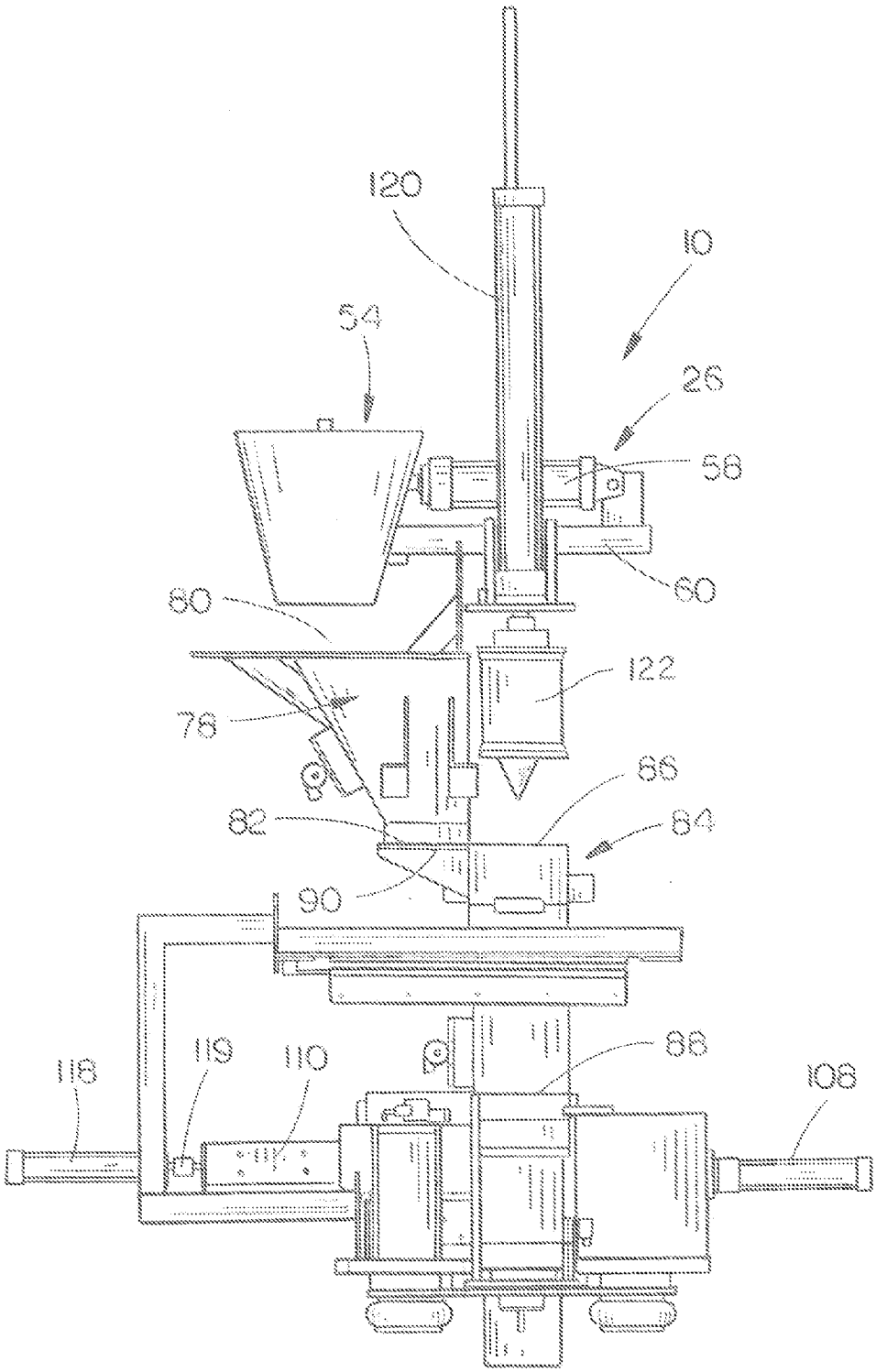
FIG. 8 is a view similar to FIG. 7 except that the shot glass assembly has been moved to a second position.
Figure 9:
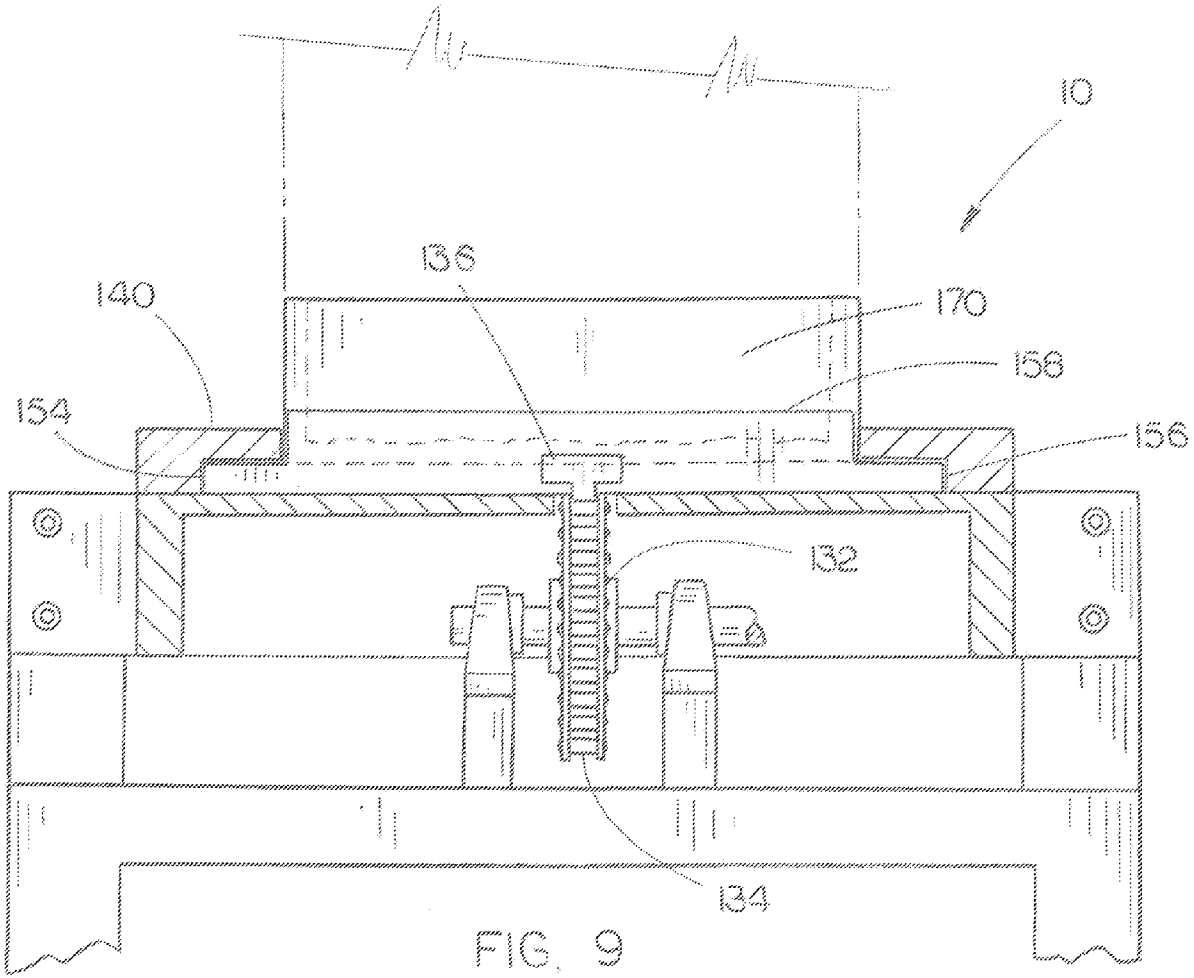
FIG. 9 is a partial sectional view of the conveyor which conveys the mats to the machine of the co-pending application.

A shot glass 84 assembly is positioned below chute 78 and is horizontally movable from a first position as seen in FIG. 7 to a second position, as seen in FIG. 8. The shot glass 84 assembly has an open upper end 86 and an open lower end 88. A horizontally extending plate 90 is positioned at the rearward side of shot glass 84 assembly at the upper end thereof. When shot glass 84 is in its first position of FIG. 7, the plate 90 is positioned rearwardly of the lower end of chute 78. When shot glass 84 assembly is in its second position of FIG. 8, plate 90 closes the lower end 82 of chute 78. Shot glass 84 assembly is moved between its first and second positions by an air cylinder 92.

Figure 11:
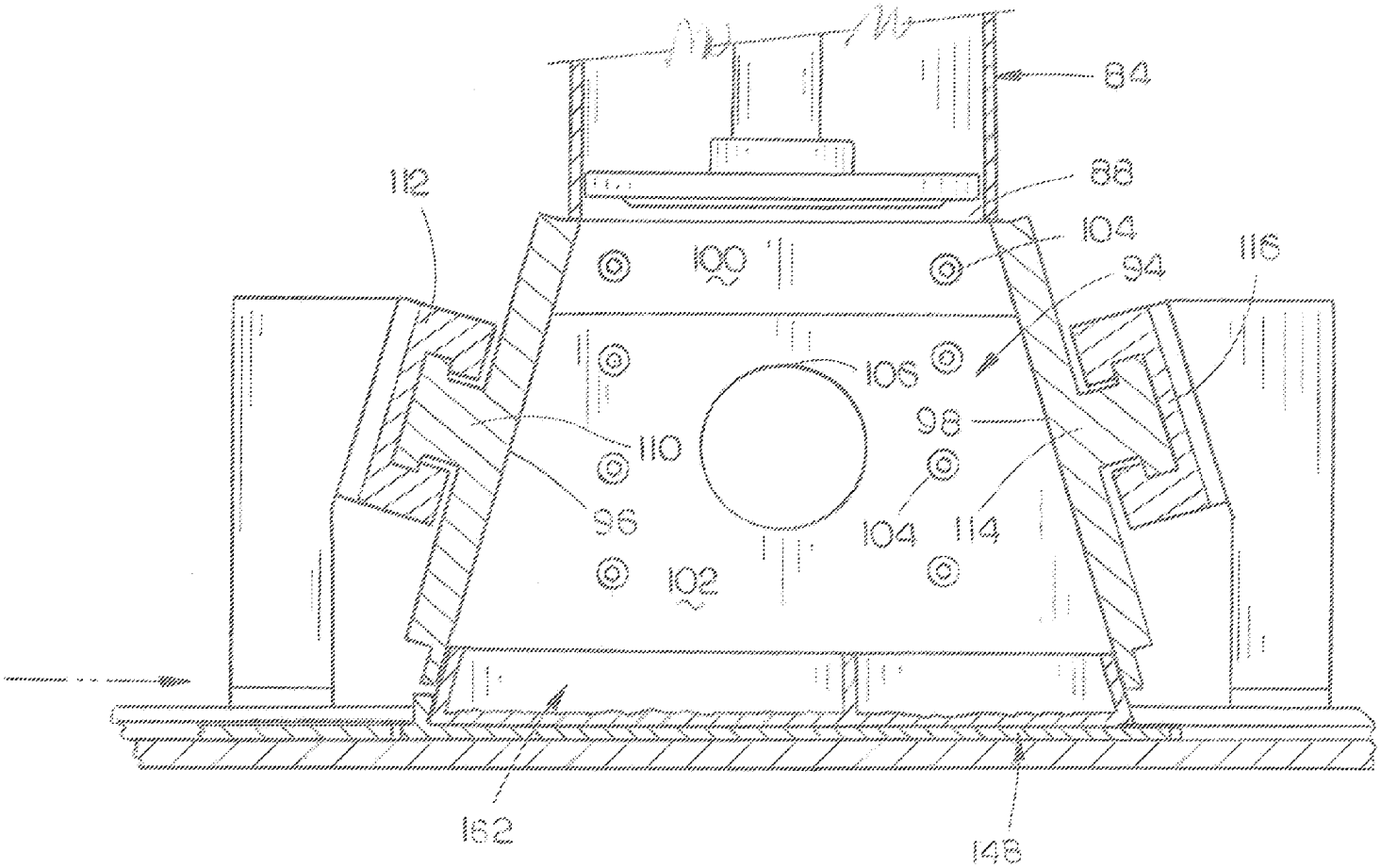
FIG. 11 is a partial sectional view of the mold box of the co-pending application and its relationship with respect to the compaction head and a mat positioned within the mold box.
Figure 12:
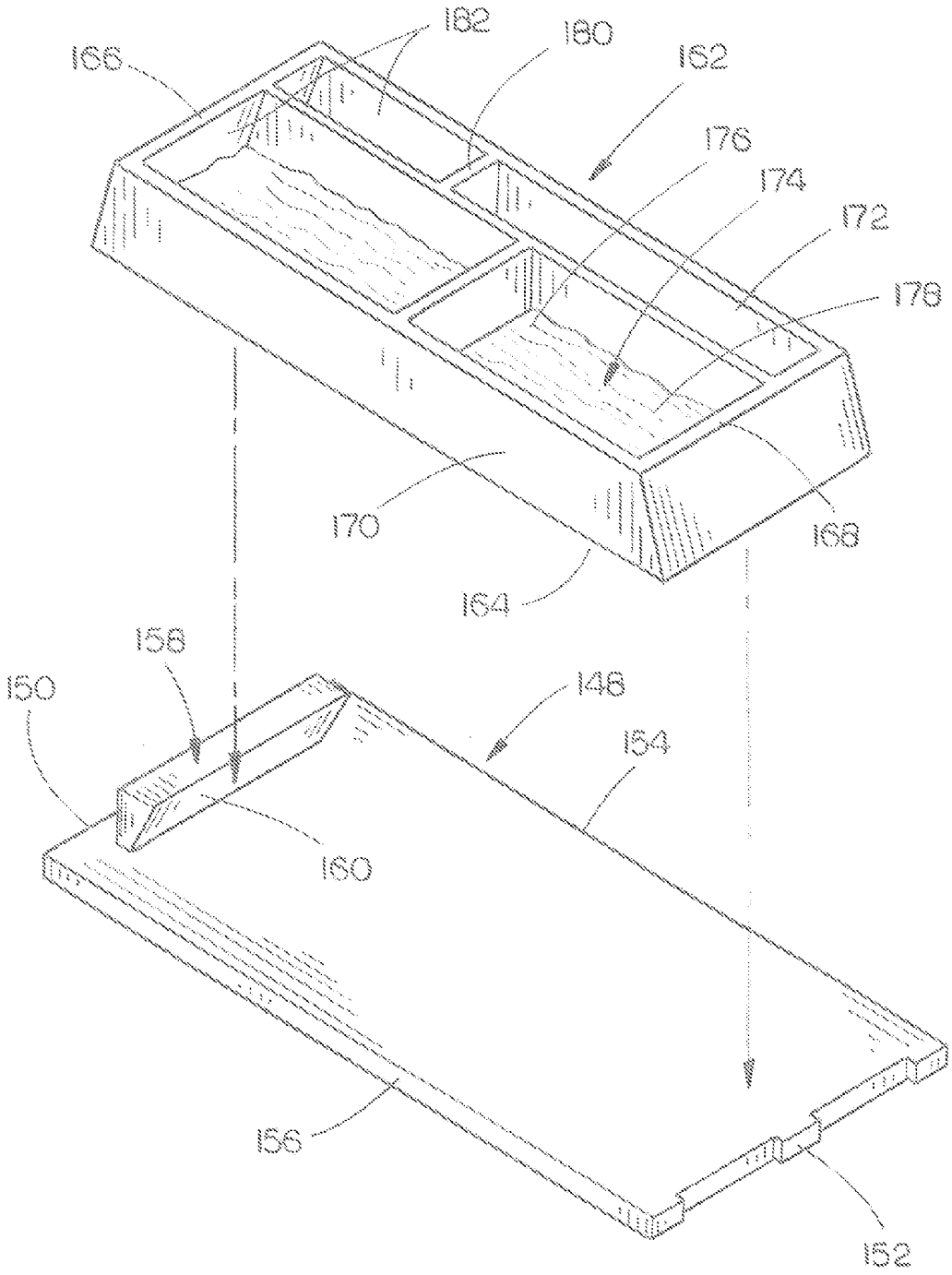
FIG. 12 is an exploded perspective view of a mat of the co-pending application and its relationship to a pad upon which the mat is placed.
Figure 13:
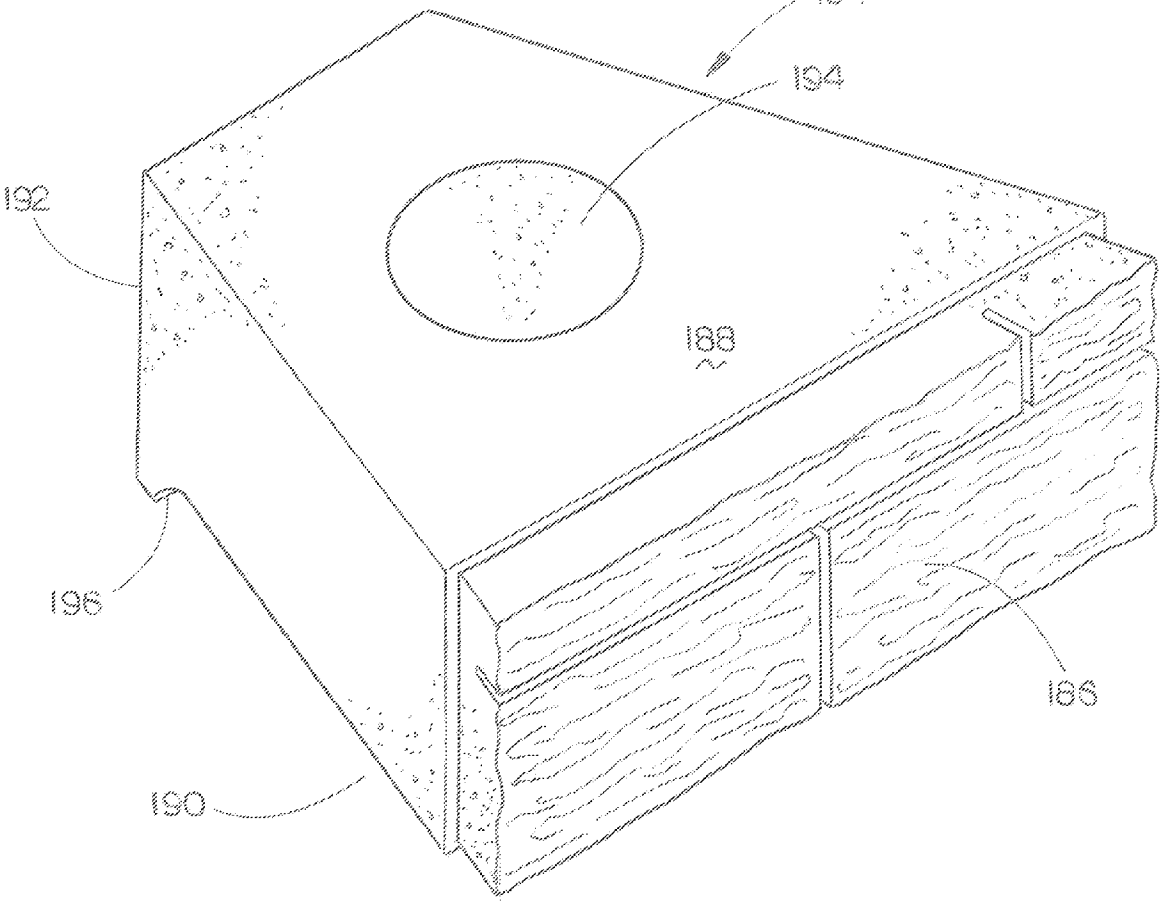
FIG. 13 is a perspective view of a finished concrete block produced by the machine of the co-pending application.

A mold box 94 is positioned below shot glass assembly 84 and is in communication with the lower open end 88 of shot glass assembly when the shot glass assembly 84 is in its second position of FIG. 8. Mold box 94 includes a front side, a back side, a first open end 96 and a second open end 98. The back side of mold box 94 has a pair of mold plates 100 and 102 selectively removably secured thereto by screws or bolts 104. The configuration of the back side of the mold box 96 may be easily changed by substituting different mold plates for the plates 100 and 102 to change the style of the concrete block being produced. The front side of mold box 94 also has one or more mold plates selectively removably secured thereto. As seen in FIG. 11, plate 102 has a circular recess 106 formed therein. The front side of mold box and one of the mold plates thereof have a circular opening formed therein. An air cylinder 108 is mounted on the frame means 12 and has a cylindrical plug secured to its cylinder rod which is adapted to be inserted through a circular opening in the front side of mold box 94, and into the circular recess 106 to form a cylindrical cavity in the block being molded.

The first open side 96 of mold box 94 is selectively closed by a first door or end plate 110 which is horizontally slidably mounted in guide 112. The second open side 98 of mold box 94 is selectively closed by a second door or end plate 114 which is horizontally slidably mounted in guide 116. An air cylinder 118 is mounted on frame means 12 and has its cylinder rod 119 secured to the doors or end plates 110 and 114 to simultaneously open and close the doors or end plates 110 and 114.

The numeral 120 refers to a vertically disposed air cylinder which is mounted on frame means 12 above the mold box and has a compaction head 122 secured to its cylinder end which is vertically movable downwardly through shot glass assembly 84 when shot glass assembly 84 is in its second position of FIG. 8.

Figure 10:
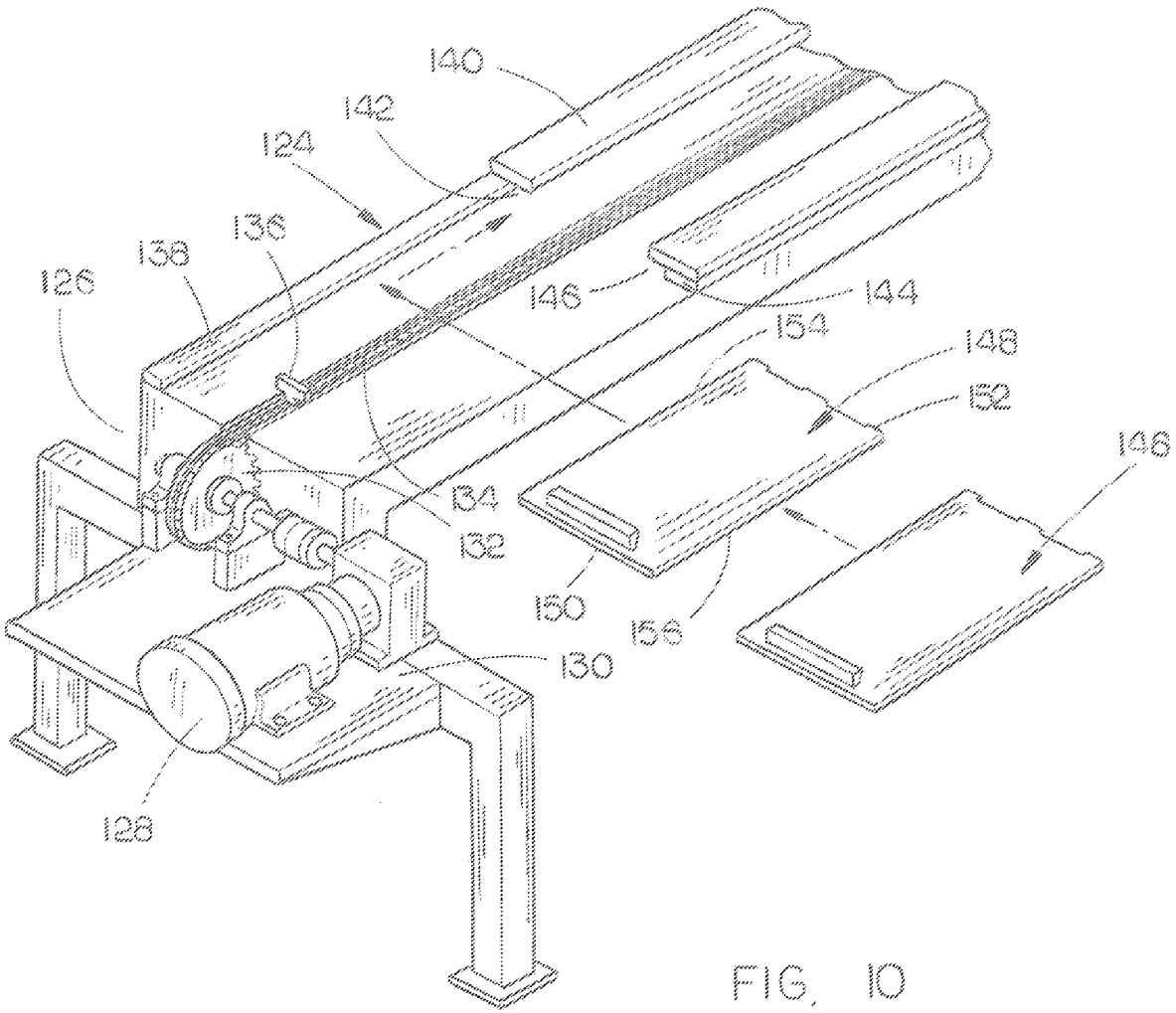
FIG. 10 is a partial perspective view illustrating the conveyor of FIG. 9.

A horizontally disposed support table 124 is positioned at the first or inlet side of the machine 10 and will be described as having an outer end 126 and an inner end 127. An electric motor 128 is mounted on frame 130 as seen in FIG. 10. Motor 128 is coupled to a sprocket 132 having a conveyor chain 134 extending therearound. The inner end of support table has a sprocket rotatably mounted thereon over which the chain 134 extends. Chain 134 has an upstanding lug or dog 136 mounted thereon. As also seen in FIG. 10, support table 124 has an elongated flat strip 138 mounted thereon at one side thereof which extends between outer and inner ends of the support table 124. A guide plate 140 is positioned on strip 138 to create a guide channel 142. As seen in FIG. 10, the outer end of plate 140 is spaced from the outer end of strip 138. As also seen in FIG. 10, the outer side of support table 124 has an elongated flat strip 144 mounted thereon which has a guide plate 146 mounted thereon to form a channel 146. As seen in FIG. 10, the outer end of strip 144 is spaced from the outer end of support table 124.

The numeral 148 refers to a metal pad having an outer end 150, an inner end 152, and opposite side edges 154 and 156. An upstanding lug 158 is secured to the upper surface of pad 148 and has a tapered inner end 160.

The numeral 162 refers to a mold tray which is comprised of urethane which is a POLYTEX® 75-70 or 75-80 material. Tray 162 includes a bottom wall 164, end walls 166 and 168, and side walls 170 and 172. Each of the walls 164, 166, 168, 170 and 172 has inside surfaces. The inside surface of bottom wall 164 has an irregular surface 174 molded therein with indentations 176 and ridges 178. If the concrete block which is to be formed by the tray 162 is to have a plurality of generally rectangular face portions, a plurality of upstanding ribs or partitions 180 are molded with the tray 162 which extend upwardly from the inside surface of bottom wall 164 to define a plurality of generally rectangular cavities 182. The tray as disclosed will be used to create a concrete block 184 having a front face 186, upper surface 188, lower surface 190, back face or surface 192, cavity 194, and set-back lip 196.

A suitable dry-cast concrete product for use with the machine 10 will be comprised of approximately 2.4% by weight water, 21.6% by weight aggregate (sand and gravel) and 15.9% by weight PORTLAND DURACEM®. A suitable compaction pressure is approximately 850 psi.

The concrete block molding machine of the invention of FIGS. 1-13 operates as follows. In the starting position, the concrete conveyor 76 is "off". The tray conveyor 134 is "off". End doors or plates 110 and 114 of the mold box 94 are "open" due to the previous retraction of the air cylinder 118. The air cylinder 108 with the plug attached to the cylinder rod thereof is in a retracted position. The vibrator for the machine is "off". The cylinder 120 is in the retracted position so that the compaction or compression head 122 is in the "up" position. The hopper 54 is in its non-dumping position. The lower switch 72 is engaged by the support member 42.

The sequential operation of the machine of the co-pending application will now be described. A plurality of the metal pads 148 are then positioned on the support table in an end-to-end relationship with the innermost pads 148 having their side edges received by the channels 142 and 144. The mold trays 162 are then placed on the pads 148 with the outer ends thereof being in engagement with the lugs 158. The upstanding lug 136 on the conveyor chain 134 will be positioned adjacent the outer end of the outermost pad 148 on the support table 124. The main control electrical switch for the machine is then switched to the "on" position. At this time, the tray conveyor 134 is energized which pushes the pads 148 with the trays 162 thereon inwardly towards the machine. The tray conveyor 134 pushes the innermost pad 148 and tray 162 into the compaction chamber of the mold box through the open end door or plate 110. The end doors or plates 110 and 114 are then closed due to the extension of the air cylinder 118. The air cylinder 108 is extended so that the plug thereon extends into and through the compaction chamber.

The concrete conveyor 76 then begins dumping concrete into the hopper 54. As the concrete is dumped into the hopper 54, the outer end of the support member 42 moves upwardly due to the weight of the concrete in the hopper 54. When the proper amount of concrete, as determined by the weight thereof, is reached the outer end of the support member 42 engages the upper switch 70, the concrete conveyor 76 stops and the hopper 54 is moved to its dumping position with the concrete in the hopper dumping into the upper end of the chute 78. At this time, the shot glass assembly will be in the position of FIG. 7. After the hopper 54 has dumped the concrete therefrom, the hopper 54 returns to its non-dumping position. At this time, the vibrator for the machine will be turned "on". The shot glass assembly 84 is then moved from the position of FIG. 7 to the position of FIG. 8. The air cylinder 120 is then extended which causes the compaction head 122 to move downwardly through the shot glass assembly 84 to the position of FIG. 11 to compact the concrete within the compaction chamber of the mold box 94. When the concrete in the compaction chamber of the mold box 94 has been compacted, the air cylinder 120 is retracted to cause the compaction head 122 to move upwardly through the shot glass assembly 84. At this time, the vibrator will stop. The end doors or plates 110 and 114 are then automatically opened and the conveyor chain 134 is moved inwardly so that the molded block 184 in the tray 162 on the pad 148 is pushed out of the compaction chamber of the mold box 94 by a new tray 162 being moved into the compaction chamber. The shot glass assembly 84 is then moved from the position of FIG. 8 to the position of FIG. 7. The sequence is then repeated.

The instant invention which is illustrated in FIGS. 14-23 will now be described.

The apparatus of the instant invention which is shown in FIGS. 14-23, is referred to generally by the reference numeral 200. Apparatus 200 replaces the structure shown in the co-pending application and more particularly the conveyor chain and the pad 148. Apparatus 200 includes a generally horizontally disposed support 202 which is positioned at the inlet side of the machine 10 and which is attached thereto by any convenient means. Support 202 will be described as having an inner end 204 and an outer end 206. The support 202 may be supported upon any convenient structure. A housing 208 is mounted on support 202 and preferably partially encloses an electric motor 210. Electric motor 210 could be replaced with a hydraulic motor or a double-acting hydraulic cylinder if so desired.

Motor 210 includes a gear box driven rotatable power shaft 211 having a pinion gear 212 mounted thereon for rotation therewith. An elongated gear rack 213, which is mounted on an elongated steel bar 214, is in mesh with the pinion gear of the motor 210 whereby rotation of motor 210 in one direction causes the steel bar 214 and rack 213 to move towards the machine 10. Rotation of motor 210 in a reverse direction causes the steel bar 214 and gear rack 213 to move away from the machine 10. A tray pusher 216 is secured to bar 214 for movement therewith with the tray pusher 216 extending downwardly from bar 214 adjacent the inner end thereof.

The numeral 218 refers to a pusher shoe support having an outer end 220 and an inner end 222. The inner end of 222 of pusher shoe support 218 has an upper beveled portion 224 and a lower beveled portion 226. A pusher shoe 228 in the form of a plate is pivotally secured, about a horizontal axis which is transverse to the longitudinal axis of bar 214, to the inner end of support end of support 218 at 230.

Figure 17:
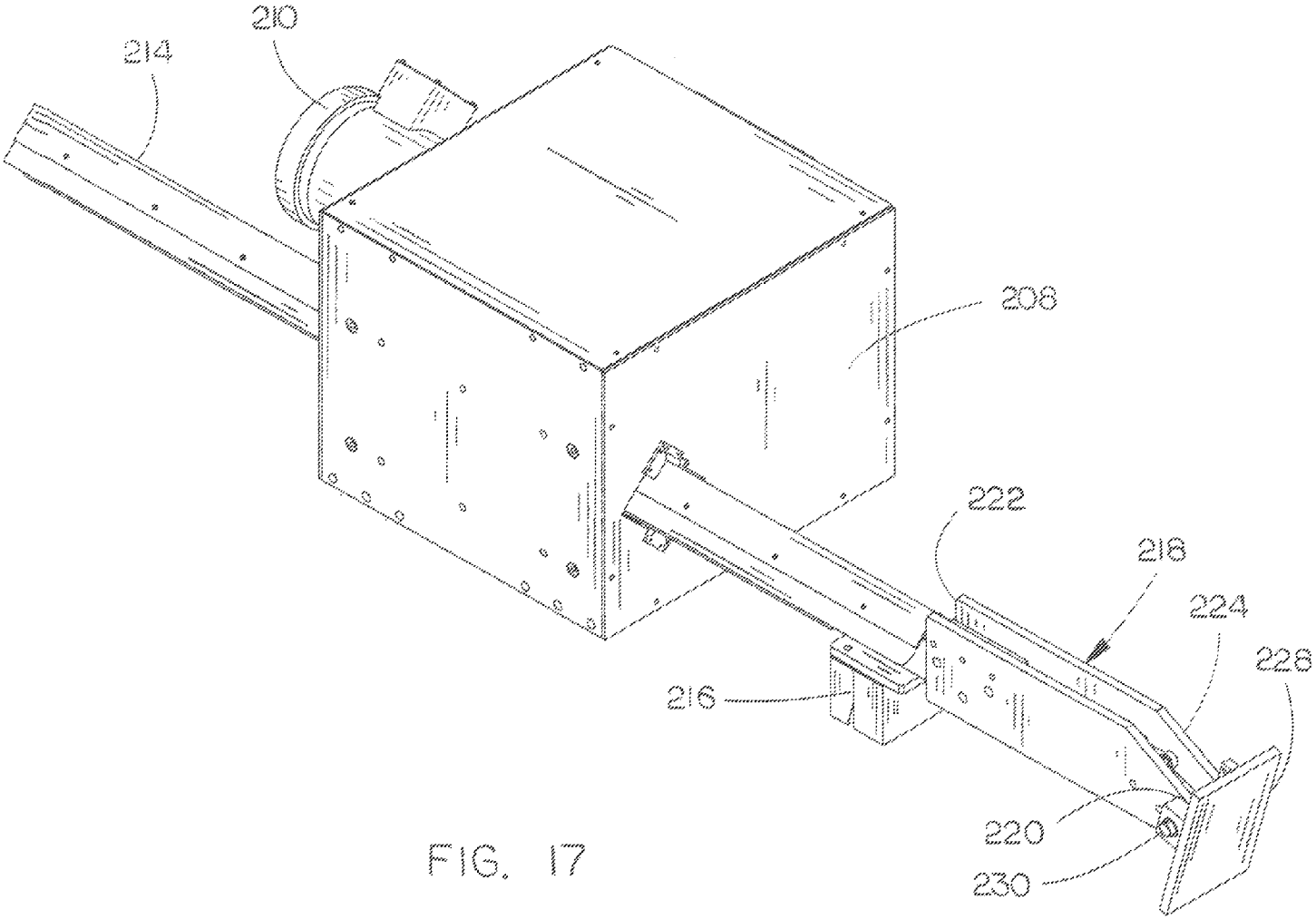
FIG. 17 is a perspective view of a portion of the instant invention which illustrates a mold tray insertion and concrete block ejection portion of the invention.
Figure 18:
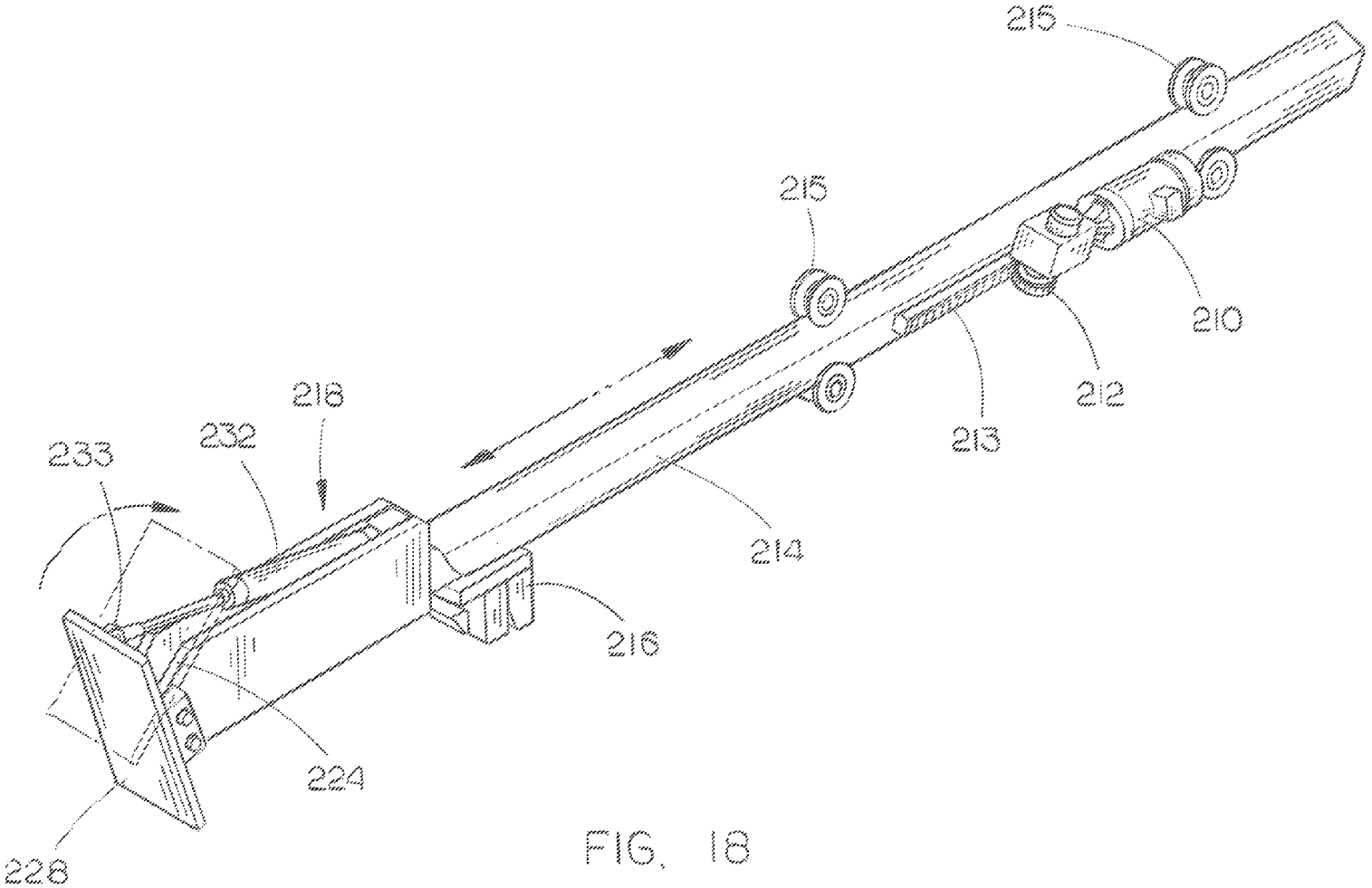
FIG. 18 is a perspective view of the mold tray insertion and concrete block ejection portion of the instant invention.
Figure 19:
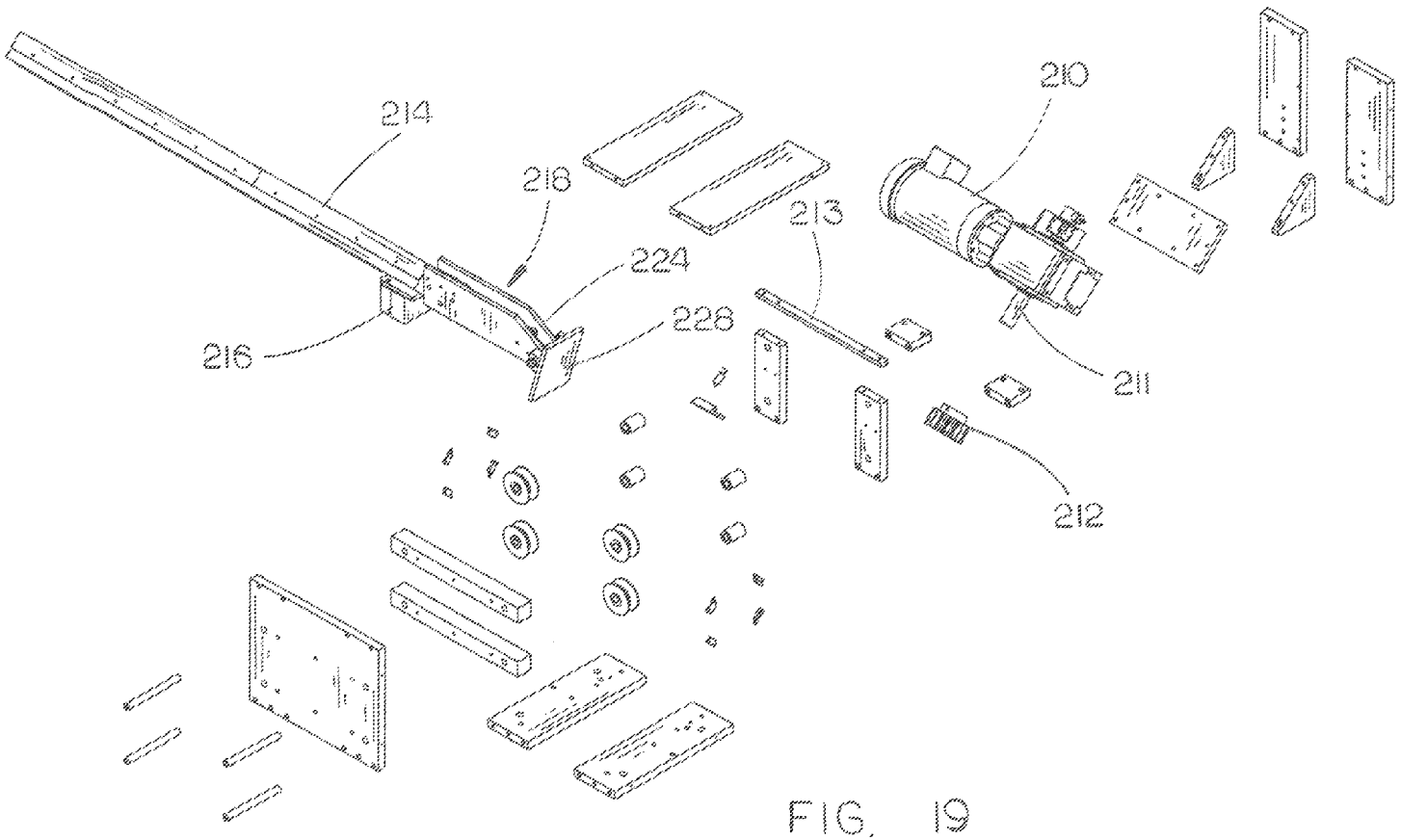
FIG. 19 is an exploded perspective view of the mold tray insertion and concrete block ejection system of this invention.
Figure 20:
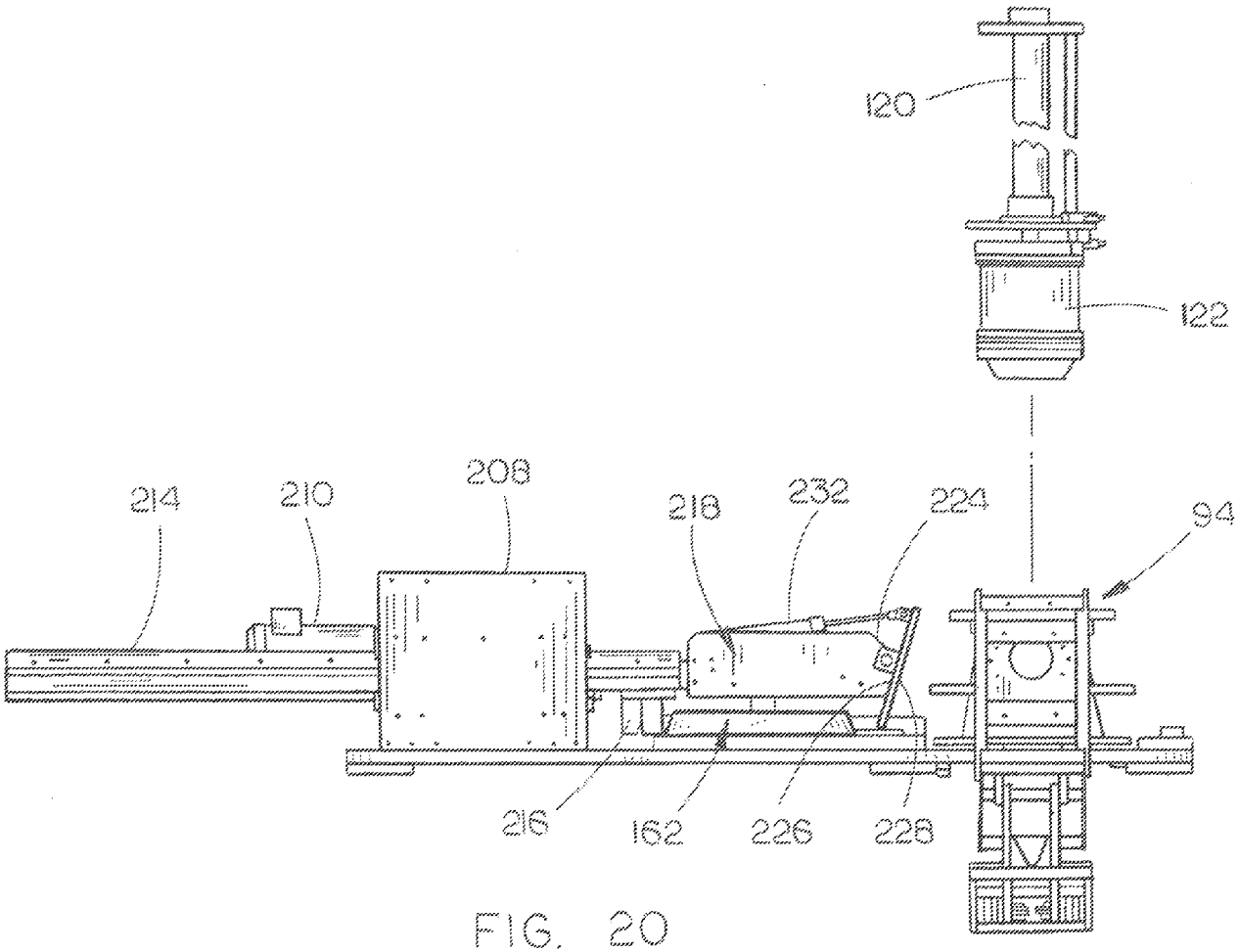
FIG. 20 is a side view of a portion of the instant invention.
Figure 21:
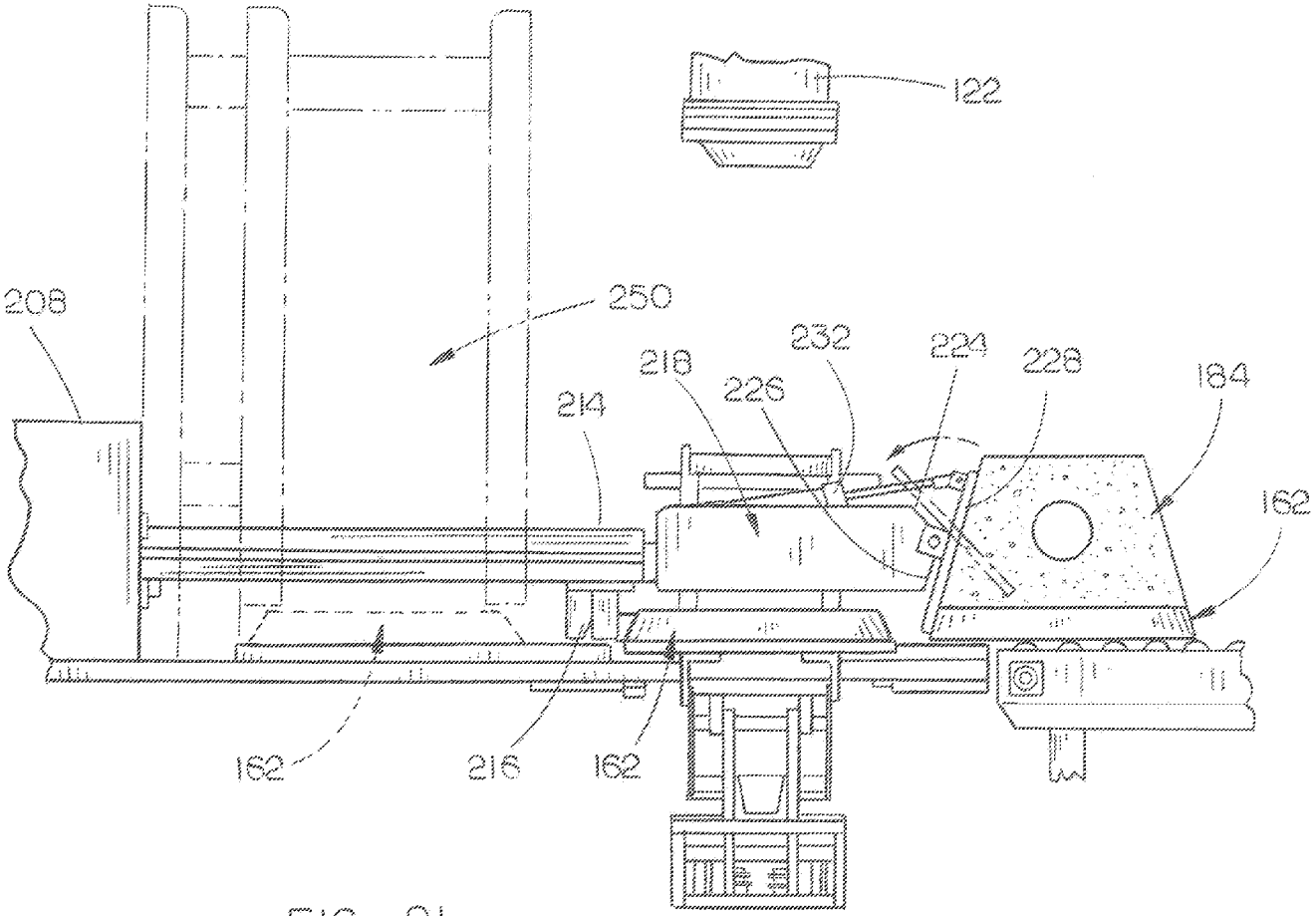
FIG. 21 is a side elevational view illustrating the mold tray insertion and concrete block ejection system pushing concrete block from the mold box with an empty mold tray being positioned in the mold box.
Figure 22:
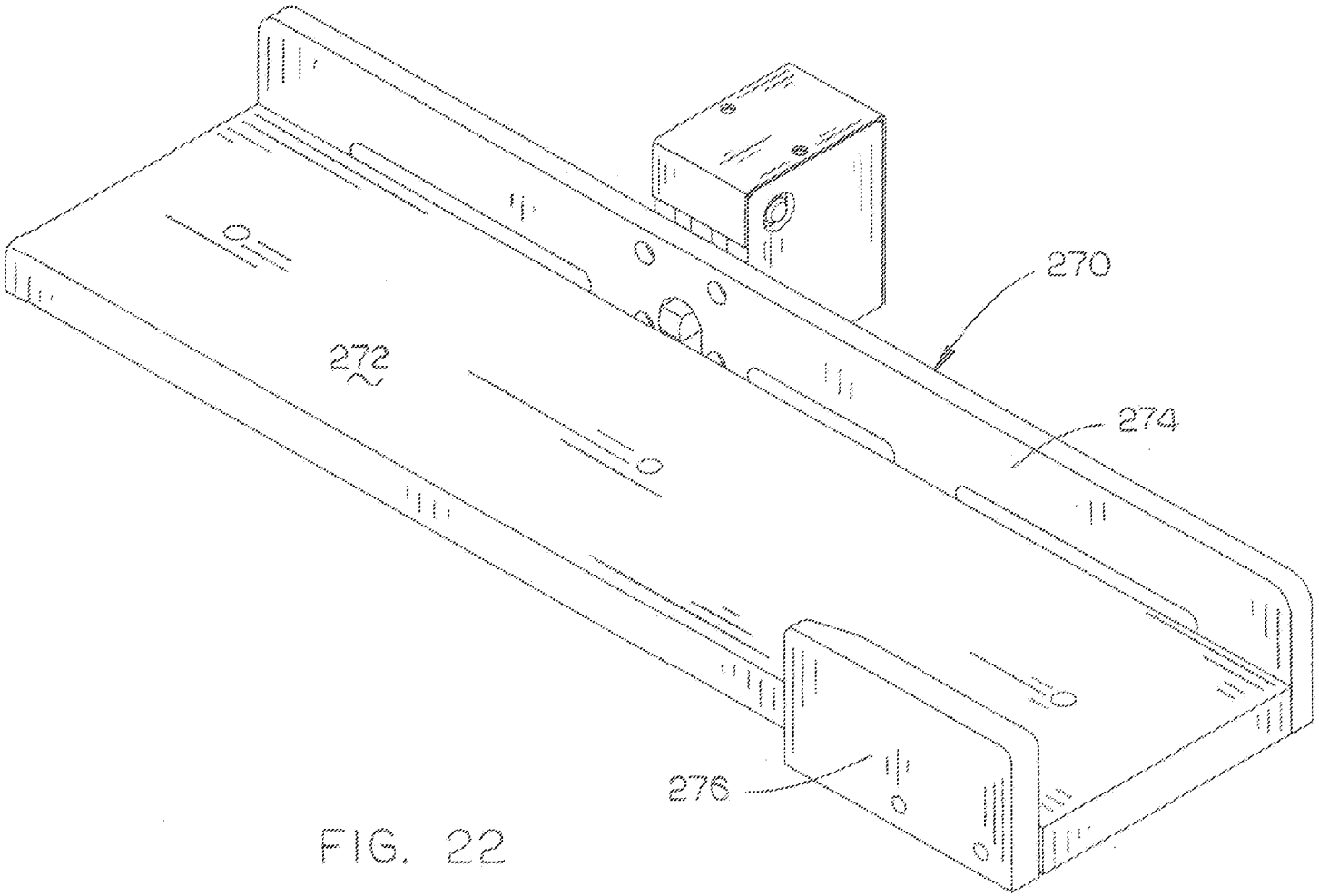
FIG. 22 is a perspective view of the mold tray guide portion of the instant invention.
Figure 23:
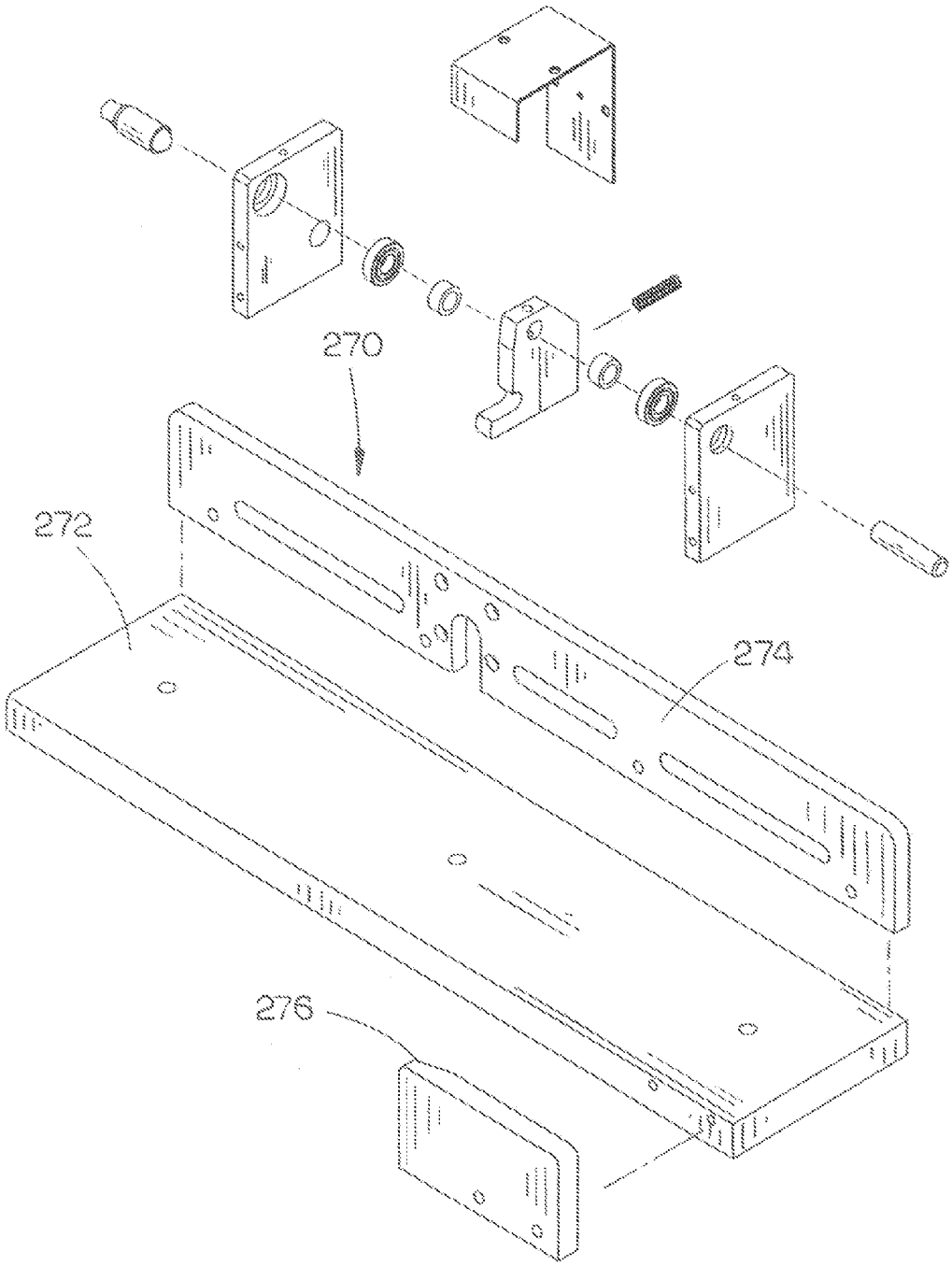
FIG. 23 is an exploded view of the guide tray of FIG. 22.

Shoe 228 is pivotally movable from a first position, illustrated by broken lines in FIG. 18, wherein the upper outer side of shoe 228 engages the upper beveled portion 224 of support 218 to a second position where the lower outer side of shoe 228 engages the lower beveled portion 226 of support 218 as seen in FIG. 17.

The numeral 232 refers to a hydraulic or air cylinder which has its base end pivotally secured, about a horizontal axis, to support 218. The rod end of cylinder 232 is pivotally secured to the upper end of shoe 228 at 233. The extension of the rod of cylinder 232 causes the shoe to be pivoted to its second position. The retraction of a cylinder rod of cylinder 232 causes the shoe 228 to be pivotally moved to the first position which is illustrated by broken lines in FIG. 18.

The numeral 250 refers to a mold tray magazine and mold tray positioning apparatus. It is preferred that the apparatus just described includes the apparatus 250 but the previously described apparatus perfectly functions without apparatus 250.

Figure 14:
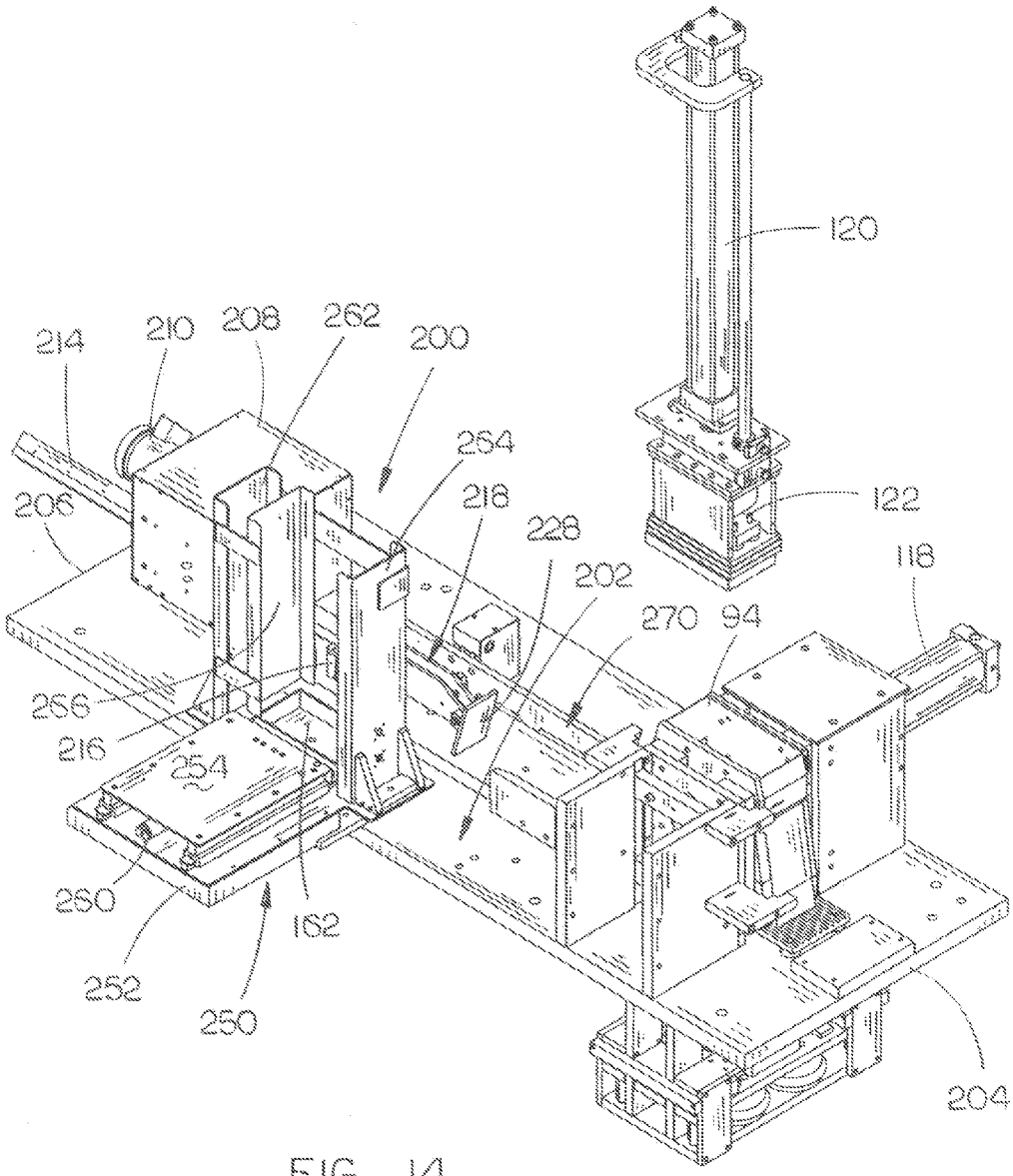
FIG. 14 is a perspective view of the instant invention.

Apparatus 250 includes a base or base plate 252 which is secured to support 202 as seen in FIG. 14. As seen, base plate 252 is disposed transversely with respect to support 202 so as to extend horizontally laterally therefrom. Apparatus 250 includes a support slide 254 which is slidably movably mounted on a pair of slide supports 256 and 258. Support slide 254 is selectively movable from the retracted position of FIG. 15 to the extended position of FIG. 16 by means of a hydraulic or air cylinder 260.

Figure 15:
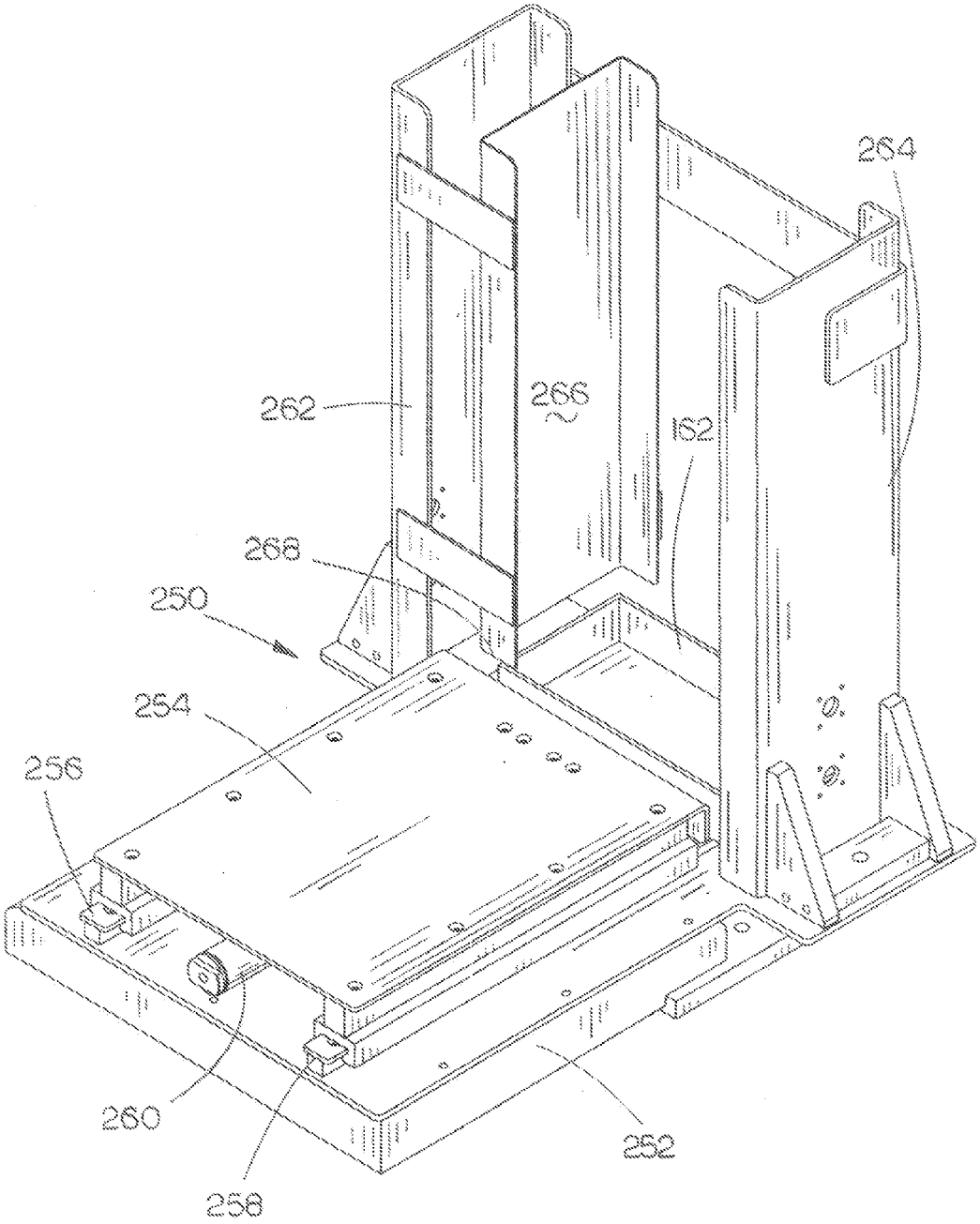
FIG. 15 is a perspective view of a portion of the instant invention.
Figure 16:
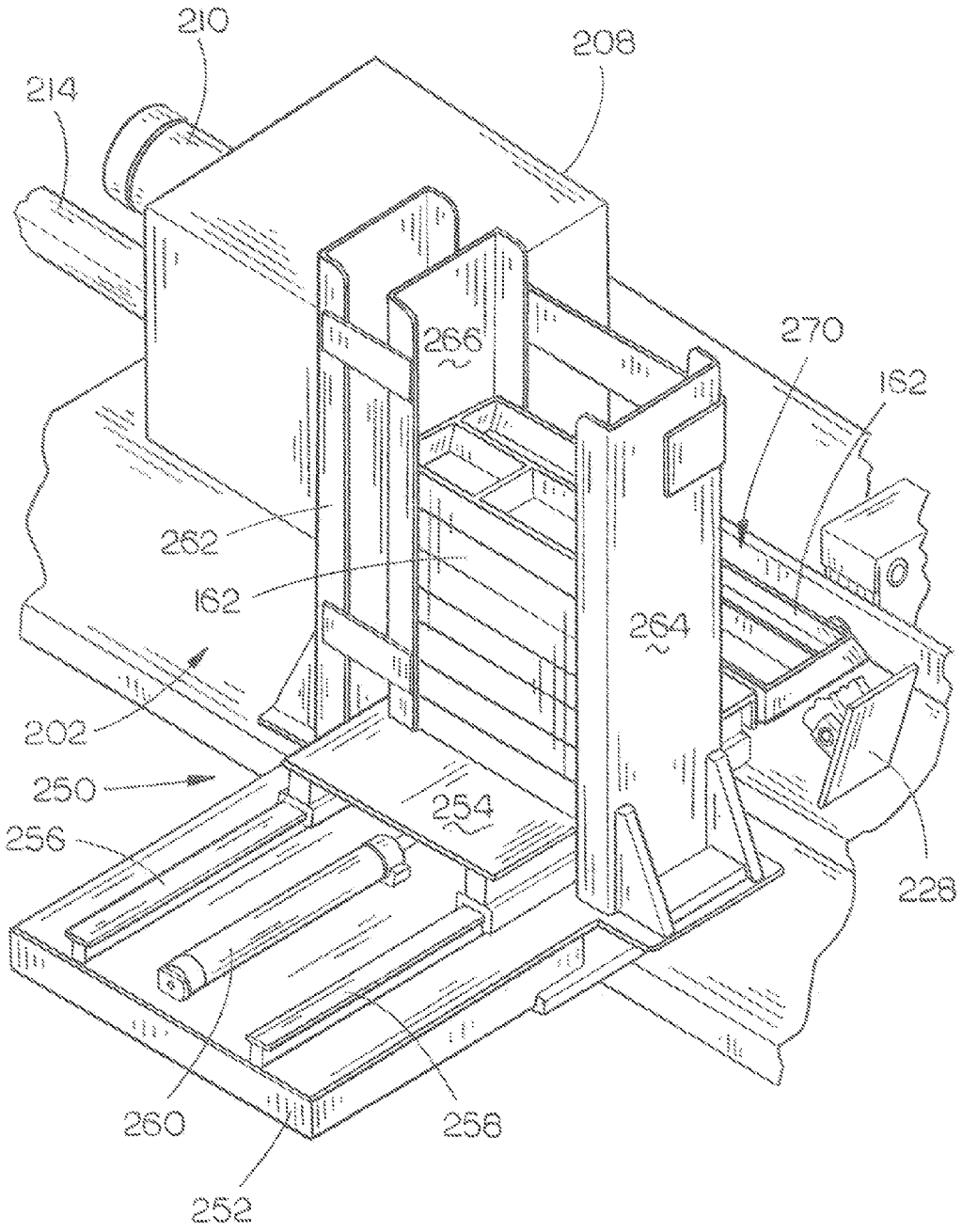
FIG. 16 is a perspective view similar to FIG. 15 except that a plurality of mold trays are shown as being positioned in the magazine portion of the invention.

A pair of vertically disposed channel members 262 and 264 are secured to base plate 252 and extend upwardly therefrom in a horizontally spaced-apart manner. A vertically disposed channel member 266 is secured to channel member 262 as seen in FIG. 15 so as to be spaced from channel member 262. As seen in FIG. 15, the lower end 268 of channel member 266 is positioned slightly above the upper surface of support slide 254 so that support slide 254 may pass thereunder.

A longitudinally extending mold tray guide 270 is secured to base plate 252 inwardly of the inner ends of panel members 262 and 264. Mold tray guide 270 includes a bottom plate 272 which has a side plate 274 extending upwardly from one side edge thereof. A shorter side plate 276 extends upwardly from the other side edge of bottom plate 272.

The operation of the instant invention is as follows.

Assuming that machine 10 is starting up and has not already cast a concrete block, end plate 110 of mold box 94 will be open. The support slide 254 will be in the position of FIG. 14. A plurality of mold trays 162 will be stacked between the channel members 264 and 266 with the lower most mold tray 162 resting on the support 202. At that point, the bar 214 will be in its retracted position. The cylinder 260 is then extended so that the support slide 254 pushes the lower most mold tray 162 laterally from the stack of mold trays between the channel members 264 and 266 onto the bottom plate 272 of the mold tray guide 270.

The motor 210 is then actuated to move the bar 214 inwardly. The inward movement of the bar 214 causes the tray pusher 228 to engage the outer end of the mold tray 162 to push the mold tray 162 into the mold box 94. Cylinder 232 is then retracted to move the pusher shoe 228 from the sold line position of FIG. 18 to the broken line position of FIG. 18. The motor 210 is then reversed so that the bar 214 is moved outwardly. The broken line position of the pusher shoe 228 in FIG. 18 enables the lower end of the pusher shoe 228 to pass over the mold tray 162 in the mold box as the bar 214 is moved outwardly.

At that time, the end plate 110 will be closed and the machine 10 will cast a block 184 in the mold tray 162 which is positioned in the mold box 94. When the block 184 has been cast, the support slide 254 is moved to its outer position by the cylinder 260. When the support slide 254 has been moved to the position of FIG. 14, another tray 162 will drop downwardly from the stack of mold trays 162 so as to be positioned at the inner end of the support slide 254. The cylinder 260 is then extended which will push another mold tray 162 onto the mold tray guide 270. The motor 210 is then activated so that the bar 214 is moved inwardly towards the mold box 94. The tray pusher 216 pushes the mold tray 162 which is positioned on the mold tray guide 270 towards the mold box 94 with the end plates 110 and 112 having been opened after the block 184 has been cast. During the inward movement of the bar 214, the cylinder 232 will have been extended so as to position the pusher shoe 228 in the solid line position of FIG. 18. As the bar 214 is moved inwardly, the pusher shoe 228 engages the cast block 184 in the mold box and pushes the same outwardly therefrom onto a conveyor or the like. At the same time as the block 184 is being pushed out of the mold box 94, the tray pusher 216 will have pushed the empty mold tray 162 into the mold box. When the block 184 has been pushed from the mold box 94 and the empty mold tray 162 has been positioned in the mold box, the cylinder 232 is retracted to move the pusher shoe 228 from the solid line position of FIG. 18 to the broken line position of FIG. 18. The bar 214 is then moved outwardly to its recessed position. At that time, the end plates of the mold box 94 will be closed so that another block may be cast in the mold box.

The procedure just described will be repeated each time another block is to be cast.

Thus it can be seen that a unique apparatus has been provided to efficiently dry cast concrete blocks.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. A dry-cast concrete block molding machine, comprising:

an upstanding frame means having an upper end, a lower end, a first side, a second side, a front side and a back side;

a concrete block mold box mounted on said frame means;

said concrete block mold box including an open first end and an open second end;

an upstanding first mold box end plate selectively horizontally movably mounted on said frame means;

said first mold box end plate being selectively horizontally movable on said frame means between open and closed positions relative to said mold box;

said first mold box end plate, when in said closed position, closing said open first end of said mold box;

an upstanding second mold box end plate selectively horizontally movably mounted on said frame means;

said second mold box end plate being selectively horizontally movable on said frame means between open and closed positions relative to said mold box;

said second mold box end plate, when in said closed position, closing said open second end of said mold box;

means for selectively supplying dry-cast concrete into said mold box when said first and second mold box end plates are in said closed positions;

a mold tray staging area outwardly of said first mold box end plate for supporting one or more mold trays thereon;

each of said mold trays including a bottom wall with inner and outer surfaces, an upstanding outer end wall with inner and outer surfaces and an upper end; an upstanding inner end wall with inner and outer surfaces and an upper end; an upstanding first side wall with inner and outer surfaces and an upper end; an upstanding second side wall with inner and outer surfaces and an upper end;

said inner surfaces of bottom wall said end walls and said side walls of said mold tray defining a dry-cast concrete receiving cavity;

said inner surface of said bottom wall of said mold tray having an irregular surface with indentations and ridges formed therein;

a mold tray insertion and concrete block ejection apparatus adjacent said first mold box end plate;

said mold tray insertion and concrete block ejection apparatus including:

(a) a generally horizontally disposed mold tray support having inner and outer ends;

(b) said inner end of said mold tray support being positioned adjacent said mold box;

(c) an elongated generally horizontally disposed and generally horizontally movable actuator having inner and outer ends, which is selectively movable with respect to said mold tray support between inner and outer positions;

(d) a power means for selectively moving said actuator between said inner and outer positions;

(e) a mold tray engagement member secured to said actuator outwardly of said inner end thereof and which extends downwardly therefrom;

(f) a pusher shoe member, having upper and lower ends, pivotally secured to said inner end of said actuator about a horizontal axis which is transversely disposed with respect to said actuator;

(g) said pusher shoe member being pivotally movable between a first pusher position to a second neutral position;

(h) said mold tray engagement member being configured to engage one end of one of said mold trays, whereby the selective movement of said actuator from said outer position to said inner position will cause that mold tray to be pushed into said mold box when said first mold box end plate is in said open position;

(i) said pusher shoe member, when in said pusher position, engaging a cast concrete block member, in said mold box, to push the cast concrete block member from the mold box, when said second mold box end plate is in said open position, as the mold tray engagement member is pushing another mold tray into said mold box;

(j) said pusher shoe member being movable to said neutral position, when said actuator is moved from said inner position to said outer position after a mold tray has been pushed into said mold box.

2. A dry-cast concrete block molding machine, comprising:

an upstanding frame means having an upper end, a lower end, a first side, a second side, a front side and a back side;

a concrete block mold box mounted on said frame means;

said concrete block mold box including an open first end and an open second end;

an upstanding first mold box end plate selectively horizontally movably mounted on said frame means;

said first mold box end plate being selectively horizontally movable on said frame means between open and closed positions relative to said mold box;

said first mold box end plate, when in said closed position, closing said open first end of said mold box;

an upstanding second mold box end plate selectively horizontally movably mounted on said frame means;

said second mold box end plate being selectively horizontally movable on said frame means between open and closed positions relative to said mold box;

said second mold box end plate, when in said closed position, closing said open second end of said mold box;

means for selectively supplying dry-cast concrete into said mold box when said first and second mold box end plates are in said closed positions;

a mold tray support adjacent said first end plate of said mold box which supports at least one mold tray; and a mold tray insertion and concrete block ejection apparatus which inserts an empty mold tray, when said first end plate is in said open position, into said mold box and which ejects a cast concrete block from said mold box when said second end plate is in said open position.

3. The dry-cast concrete block molding machine of claim 1 further including a mold tray magazine and mold tray positioning apparatus which sequentially places an empty mold tray from said mold tray magazine onto said mold tray support.

* * * * *